US006766120B2

(12) United States Patent
Yokoi

(10) Patent No.: US 6,766,120 B2
(45) Date of Patent: Jul. 20, 2004

(54) ELECTROSTATIC IMAGE FORMING DEVICE WITH CONDITIONAL TONER CLEANING ROLLER

(75) Inventor: Katsuyuki Yokoi, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/154,842

(22) Filed: May 28, 2002

(65) Prior Publication Data

US 2002/0176716 A1 Nov. 28, 2002

(30) Foreign Application Priority Data

May 25, 2001 (JP) ..... 2001-157090

(51) Int. Cl.[7] ..... G03G 21/00
(52) U.S. Cl. ..... 399/21; 399/43
(58) Field of Search ..... 399/21, 18, 16, 399/43, 44

(56) References Cited

U.S. PATENT DOCUMENTS 5,857,132 A * 1/1999 Mizuishi et al. ..... 399/66

FOREIGN PATENT DOCUMENTS

JP 2000-147914 * 5/2000
JP 2001-66958 * 3/2001

* cited by examiner

*Primary Examiner*—Quana Grainger
(74) *Attorney, Agent, or Firm*—Oliff & Berridge PLC

(57) ABSTRACT

In a laser printer, when a sheet of paper, which is to be supplied in between a photosensitive drum and a transfer roller, is jammed, after the sheet of paper is removed and the jam is cleared up, a developing jam control program is executed to rotate a drum cleaning roller at a rotational speed higher than a normal rotational speed and to apply the transfer roller with a reverse bias voltage whose polarity is the same as that of the charged toner.

14 Claims, 16 Drawing Sheets

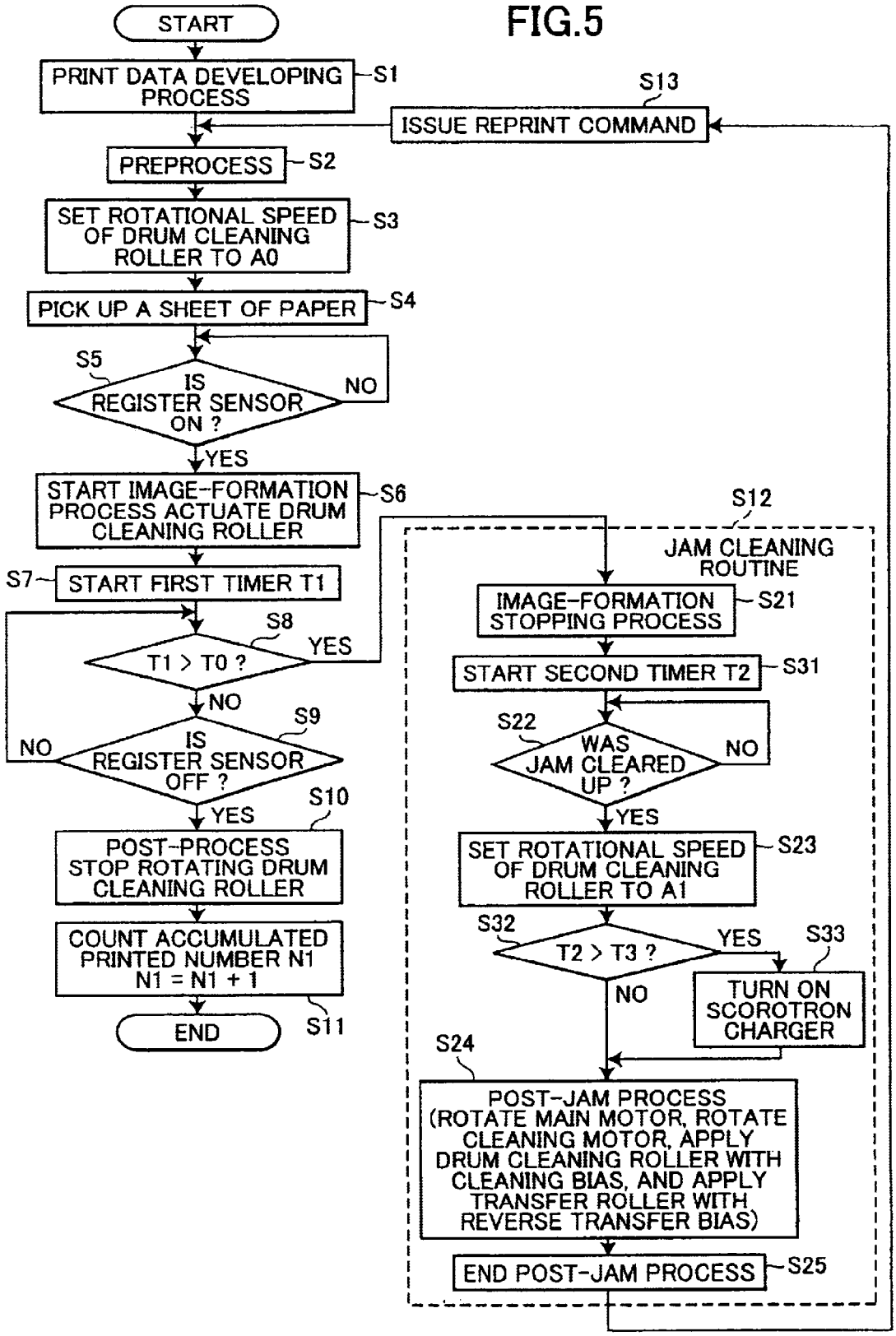
FIG.5
START
PRINT DATA DEVELOPING PROCESS
S1
PREPROCESS
S2
SET ROTATIONAL SPEED OF DRUM CLEANING ROLLER TO A0
S3
PICK UP A SHEET OF PAPER
S4
S5
IS REGISTER SENSOR ON ?
NO
YES
START IMAGE-FORMATION PROCESS ACTUATE DRUM CLEANING ROLLER
S6
S7
START FIRST TIMER T1
S8
T1 > T0 ?
YES
NO
S9
IS REGISTER SENSOR OFF ?
NO
YES
S10
POST-PROCESS STOP ROTATING DRUM CLEANING ROLLER
COUNT ACCUMULATED PRINTED NUMBER N1
N1 = N1 + 1
END
S11
S13
ISSUE REPRINT COMMAND
S12
JAM CLEANING ROUTINE
IMAGE-FORMATION STOPPING PROCESS
S21
START SECOND TIMER T2
S31
S22
WAS JAM CLEARED UP ?
NO
YES
SET ROTATIONAL SPEED OF DRUM CLEANING ROLLER TO A1
S23
S32
T2 > T3 ?
YES
S33
NO
TURN ON SCOROTRON CHARGER
S24
POST-JAM PROCESS (ROTATE MAIN MOTOR, ROTATE CLEANING MOTOR, APPLY DRUM CLEANING ROLLER WITH CLEANING BIAS, AND APPLY TRANSFER ROLLER WITH REVERSE TRANSFER BIAS)
END POST-JAM PROCESS
S25

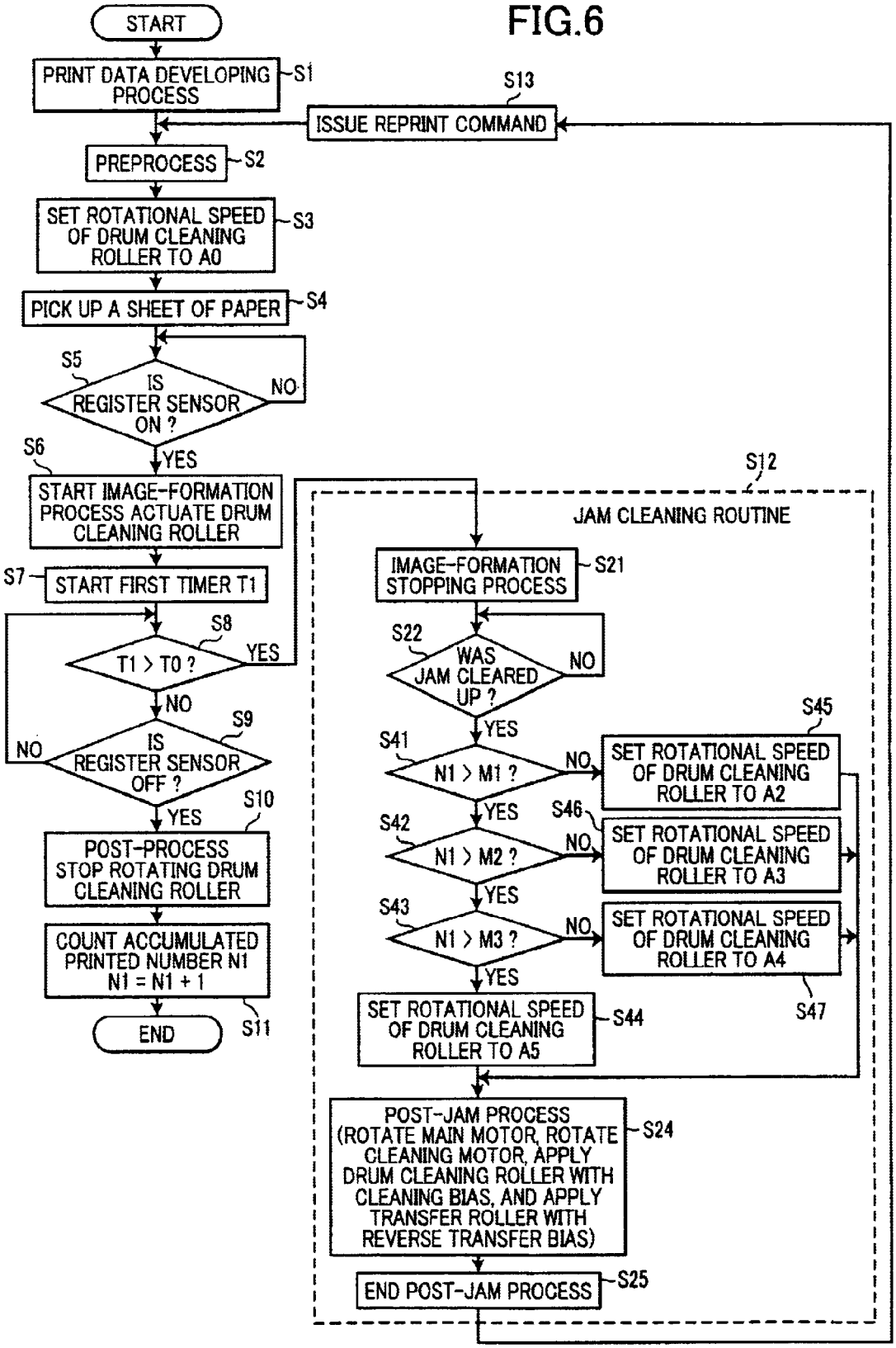
FIG.6
START
PRINT DATA DEVELOPING PROCESS
S1
PREPROCESS
S2
SET ROTATIONAL SPEED OF DRUM CLEANING ROLLER TO A0
S3
PICK UP A SHEET OF PAPER
S4
S5
IS REGISTER SENSOR ON ?
NO
YES
S6
START IMAGE-FORMATION PROCESS ACTUATE DRUM CLEANING ROLLER
S7
START FIRST TIMER T1
S8
T1 > T0 ?
YES
NO
S9
IS REGISTER SENSOR OFF ?
NO
YES
S10
POST-PROCESS STOP ROTATING DRUM CLEANING ROLLER
COUNT ACCUMULATED PRINTED NUMBER N1 N1 = N1 + 1
S11
END
S13
ISSUE REPRINT COMMAND
S12
JAM CLEANING ROUTINE
IMAGE-FORMATION STOPPING PROCESS
S21
S22
WAS JAM CLEARED UP ?
NO
YES
S41
N1 > M1 ?
NO
YES
S42
N1 > M2 ?
NO
YES
S43
N1 > M3 ?
NO
YES
S45
SET ROTATIONAL SPEED OF DRUM CLEANING ROLLER TO A2
S46
SET ROTATIONAL SPEED OF DRUM CLEANING ROLLER TO A3
SET ROTATIONAL SPEED OF DRUM CLEANING ROLLER TO A4
S47
SET ROTATIONAL SPEED OF DRUM CLEANING ROLLER TO A5
S44
POST-JAM PROCESS (ROTATE MAIN MOTOR, ROTATE CLEANING MOTOR, APPLY DRUM CLEANING ROLLER WITH CLEANING BIAS, AND APPLY TRANSFER ROLLER WITH REVERSE TRANSFER BIAS)
S24
END POST-JAM PROCESS
S25

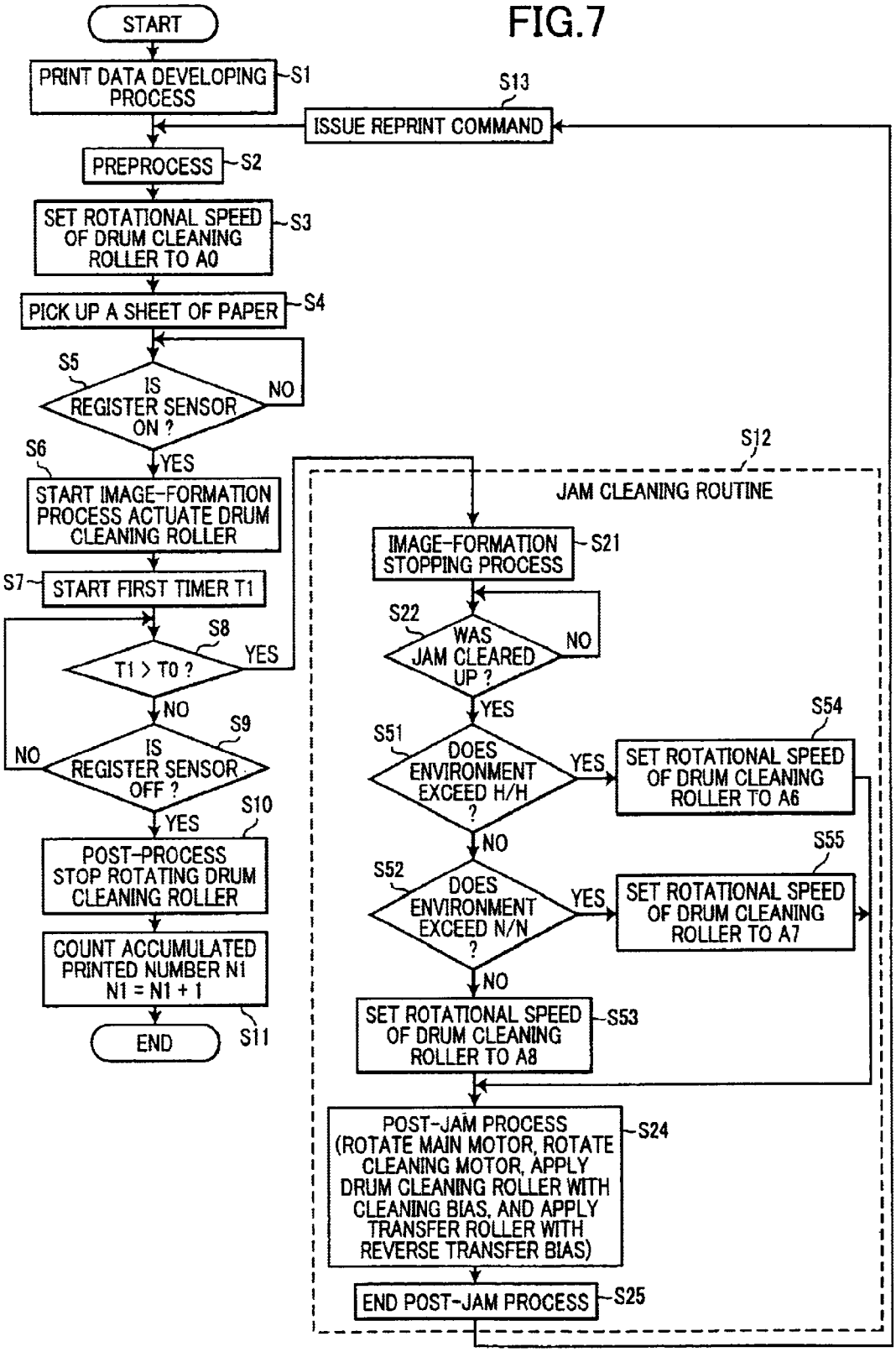
FIG.7
START
PRINT DATA DEVELOPING PROCESS
S1
PREPROCESS
S2
SET ROTATIONAL SPEED OF DRUM CLEANING ROLLER TO A0
S3
PICK UP A SHEET OF PAPER
S4
S5
IS REGISTER SENSOR ON ?
NO
YES
S6
START IMAGE-FORMATION PROCESS ACTUATE DRUM CLEANING ROLLER
S7
START FIRST TIMER T1
S8
T1 > T0 ?
YES
NO
S9
IS REGISTER SENSOR OFF ?
NO
YES
S10
POST-PROCESS STOP ROTATING DRUM CLEANING ROLLER
COUNT ACCUMULATED PRINTED NUMBER N1 N1 = N1 + 1
END
S11
S13
ISSUE REPRINT COMMAND
S12
JAM CLEANING ROUTINE
IMAGE-FORMATION STOPPING PROCESS
S21
S22
WAS JAM CLEARED UP ?
NO
YES
S51
DOES ENVIRONMENT EXCEED H/H ?
YES
S54
SET ROTATIONAL SPEED OF DRUM CLEANING ROLLER TO A6
NO
S52
DOES ENVIRONMENT EXCEED N/N ?
YES
S55
SET ROTATIONAL SPEED OF DRUM CLEANING ROLLER TO A7
NO
SET ROTATIONAL SPEED OF DRUM CLEANING ROLLER TO A8
S53
POST-JAM PROCESS (ROTATE MAIN MOTOR, ROTATE CLEANING MOTOR, APPLY DRUM CLEANING ROLLER WITH CLEANING BIAS, AND APPLY TRANSFER ROLLER WITH REVERSE TRANSFER BIAS)
S24
END POST-JAM PROCESS
S25

ELECTROSTATIC IMAGE FORMING DEVICE WITH CONDITIONAL TONER CLEANING ROLLER

BACKGROUND OF TEE INVENTION

1. Field of the Invention

The present invention relates to an image forming apparatus such as a laser printer.

2. Description of Related Art

A conventional image forming apparatus, such as a laser printer, includes a photosensitive drum and a processing unit. The processing unit includes: a charger; a scanner device; a developing roller; and a transfer roller, which are arranged around the photosensitive drum in this order in the rotating direction of the photosensitive drum. As the photosensitive drum rotates, the surface of the photosensitive drum is first charged uniformly by the charger. The photosensitive drum surface is then exposed by a laser beam, which is modulated according to prescribed image data and which is scanned by the scanner device at a high speed. As a result, an electrostatic latent image is formed on the photosensitive drum. The processing unit stores toner therein. The developing roller is supplied with toner, and a thin layer of toner is formed on the surface of the developing roller. As the developing roller rotates, toner on the developing roller confronts the photosensitive drum. As a result, toner is supplied onto the electrostatic latent image on the surface of the photosensitive drum. Toner is borne selectively on the surface of the photosensitive drum, thereby developing the electrostatic latent image into a visible toner image. Afterwardly, the visible image thus produced on the surface of the photosensitive drum confronts the transfer roller, and is transferred onto a recording sheet when the recording sheet passes between the photosensitive drum and the transfer roller.

SUMMARY OF THE INVENTION

It is conceivable to provide an image forming apparatus of a type, in which a cleaning roller is provided in the downstream side of the transfer roller in the rotational direction of the photosensitive drum. The cleaning roller is for collecting residual toner, which remains on the photosensitive drum after the toner image is transferred onto the recording sheet.

In this conceivable image forming apparatus, the cleaning roller rotates in a predetermined, fixed rotational speed while contacting with the photosensitive drum. The cleaning roller is applied with a predetermined, fixed bias voltage with respect to the photosensitive drum. After the toner image is transferred onto a recording sheet, the cleaning roller electrically collects the residual toner from the photosensitive drum, while rotatingly contacting with the photosensitive drum.

In this conceivable image forming apparatus, however, when a recording sheet is jammed in the processing unit, a larger-amount of toner will remain on the photosensitive drum. Considering this problem, it is conceivable to set the values of the rotational speed and the bias voltage of the cleaning roller to sufficiently high values so that the cleaning roller can sufficiently collect even this large-amount of toner. However, it is unnecessary to operate the cleaning roller at such a high rotational speed and with such a great bias voltage when a recording sheet is not jammed. If the cleaning roller is operated at such a high rotational speed and with such a great bias voltage also during the normal image forming process, the cleaning roller will excessively forcibly rub toner against the surface of the photosensitive drum. This will lead to filming of toner on the photosensitive drum. The image quality will be degraded, and the life of the photosensitive drum will be shortened.

In view of the above-described drawbacks, it is an objective of the present invention to solve the above-described problems and to provide an improved image forming apparatus that can properly collect a large amount of developing agent that resides on the photosensitive drum when a trouble occurs in the conveyance of the recording sheet, that maintains high image quality, and that ensures the image bearing body to have a sufficiently long life.

In order to attain the above and other objects, the present invention provides an image forming apparatus, comprising: a conveying unit; a trouble-detecting unit; a trouble-clearing-up judging unit; an image bearing body; a transfer unit; a cleaning roller; and a control unit. The conveying unit conveys a recording medium. The trouble-detecting unit detects whether some trouble occurs against conveyance of the recording medium. The trouble-clearing-up judging unit judges whether the trouble detected by the trouble-detecting unit has been cleared up. The image bearing body bears thereon a visible image, which is made from a developing agent electrically charged in a predetermined polarity. The transfer unit is located opposing the image bearing body and transfers the visible image onto the recording medium. The cleaning roller is located opposing and contacting the image bearing body and collects the developing agent from the image bearing body. The control unit applies the transfer unit with a bias voltage of a polarity opposite to that of the developing agent when the trouble-detecting unit detects no trouble. The control unit applies, when the trouble-judging unit detects some trouble, the transfer unit with a bias voltage of a polarity the same as that of the developing agent after the trouble-clearing-up judging unit judges clearing-up of the trouble.

With this configuration, the control unit applies the transfer unit with the bias voltage, whose polarity is the same as that of the developing agent after the conveyance trouble is cleared up. It is therefore possible to prevent a large amount of developing agent, which remains on the image bearing body due to the conveyance trouble, from being attached to the transfer unit. It is ensured that the large amount of developing agent be collected by the cleaning roller.

It is preferable that the control unit controls at least one of the cleaning roller and the image bearing body in a first condition when the trouble-detecting unit detects no trouble, and that the control unit controls, when the trouble-judging unit detects some trouble, the at least one of the cleaning roller and the image bearing body in a second condition that is different from the first condition after the trouble-clearing-up judging unit judges clearing-up of the trouble.

With this configuration, during the normal image forming time, at least one of the cleaning roller and the image bearing body is operated in the first operating condition. It is ensured that during the normal image forming process, the cleaning roller will not be operated in the second operating condition that corresponds to the conveyance-trouble. It is therefore possible to prevent the cleaning roller from excessively sliding against the image bearing body. It is possible to prevent image quality from being degraded due to the excessive sliding of the cleaning roller against the image bearing body. It is also possible to prevent the life of the image bearing body from being shortened due to the excessive sliding of the cleaning roller against the image bearing body.

On the other hand, when some trouble occurs against the conveyance of the recording medium, after the trouble is cleared up, the controlling unit operates at least one of the cleaning roller and the image bearing body in the second condition that is different from the first condition. Even when a large amount of developing agent remains on the image bearing body due to the conveyance trouble, the cleaning roller can properly and sufficiently collect the large amount of developing agent.

It is preferable that the control unit changes the second condition in accordance with an image-forming number indicative of the number of images which the image bearing body has produced until the trouble-detecting unit detects the trouble.

As the image-forming number, that is, the number of images formed by the image forming apparatus increases, the developing agent and the components in the apparatus will normally be degraded, and the density of images formed on the image bearing body will rise. Accordingly, the amount of the developing agent that remains on the image bearing body after the occurrence of the conveyance-trouble will increase as the image-forming number increases. According to the present invention, therefore, when the amount of the developing agent remaining on the image bearing body increases as the image-forming number increases, the control unit changes the second condition dependently on the image-forming-number. It is ensured that the cleaning roller can always collect the remaining developing agent properly and sufficiently regardless of the image-forming-number.

It is also preferable that the control unfit changes the second condition dependently on temperature and humidity in an environment where the image forming apparatus is located.

When at least one of temperature and humidity rises in the environment where the image forming apparatus is located, the density of images on the age bearing body increases. On the other hand, when at least one of temperature and humidity lowers, the image density decreases. Accordingly, when some trouble occurs in the conveyance of the recording medium, the amount of developing amount remaining on the image bearing body due to the trouble changes according to the temperature and/or humidity at the time when the trouble occurs. According to the present invention, therefore, when the amount of developing amount remaining on the image bearing body changes according to the temperature and/or humidity, the control unit changes the second condition dependently on the temperature and/or humidity. It is ensured that the cleaning roller can properly and sufficiently collect the remaining developing agent from the image bearing body regardless of the temperature or humidity.

The image forming apparatus may further comprise a charging unit electrically charging the image bearing body. In this case, the control unit may include a charging control unit controlling the charging unit to electrically charge the image bearing body if the trouble-clearing-up. Judging unit judges that it has taken a predetermined period of time or longer to clear up the trouble.

The electrically-charged amount of the developing agent reduces as time passes from when the developing agent has been charged. If it has taken the predetermined time or longer to clear up the trouble, even if the cleaning roller is applied with a proper amount of bias voltage, the cleaning roller will possibly collect the developing agent insufficiently due to the decreased charged amount of the developing agent. According to the present invention, therefore, if it has taken the predetermined time or longer to clear up the trouble, the charging control unit controls the charging unit to electrically charge the image bearing body. The charge-amount-decreased developing agent is again electrically charged, and can be properly collected by the cleaning roller.

The image forming apparatus may further comprise: a voltage applying unit applying a cleaning-bias voltage to the cleaning roller with respect to the image bearing body; and a driving unit rotating the cleaning roller at a cleaning-roller-rotational speed. In this case, the control unit may include: a setting unit that sets at least one of the cleaning-bias voltage and the cleaning-roller-rotational speed to a predetermined normal value while the trouble-detecting unit detects no trouble; and a changing unit that changes, after the trouble-clearing-up judging unit judges that the trouble is cleared up, at least one of the cleaning-bias voltage and the cleaning-roller-rotational speed into a changed value that is different from the predetermined normal value.

When some trouble occurs in the conveyance of the recording medium, the control unit changes the bias voltage applied to the cleaning roller and/or the rotational speed of the cleaning roller, after the trouble has been taken care of. Even when a large amount of developing agent remains on the image bearing body due to the conveyance-trouble, the cleaning roller can reliably collect the developing agent.

In this case, it is preferable that the setting unit sets at least one of an absolute value of the cleaning-bias voltage and the cleaning-roller-rotational speed to the predetermined normal value, the changing unit changing the at least one of the absolute value of the cleaning-bias voltage and the cleaning-roller-rotational speed into the changed value that is greater than the predetermined normal value.

Accordingly, when some trouble occurs in the conveyance of the recording medium, the bias voltage absolute value and/or the rotational speed is increased from the predetermined normal value. Accordingly, the collecting ability of the cleaning roller is enhanced, and can reliably collect the large amount of developing agent.

According to another aspect, the present invention provides an image forming apparatus, comprising: a conveying unit conveying a recording medium; a trouble-detecting unit detecting whether some trouble occurs against conveyance of the recording medium; a trouble-clearing-up judging unit judging whether the trouble detected by the trouble-detecting unit has been cleared up; an image bearing body bearing thereon a visible image, which is made from a developing agent electrically charged in a predetermined polarity; a transfer unit located opposing the image bearing body and transferring the visible image onto the recording medium; a cleaning roller located opposing and contacting the image bearing body and collecting the developing agent from the image bearing body; and a control unit controlling at least one of the cleaning roller and the image bearing body in a first condition when the trouble-detecting unit detects no trouble, the control unit controlling, when the trouble-judging unit detects some trouble, the at least one of the cleaning roller and the image bearing body in a second condition that is different from the first condition after the trouble-clearing-up judging unit judges clearing-up of the trouble.

BRIEF DESCRIPTION OF THE DRAWINGS

The above and other objects, features and advantages of the invention will become more apparent from reading the following description of the preferred embodiments taken in connection with the accompanying drawings in which:

FIG. 5 is a flowchart of a control process according to a first modification of the first embodiment, wherein a Scorotron charger is selectively turn ON after the jam is cleared up;

FIG. 6 is a flowchart of a control process according to a second modification of the first embodiment, wherein the rotational speed of the drum cleaning roller during the post-jam process changes dependently on the accumulated printed number;

FIG. 7 is a flowchart of a control process according to a third modification of the first embodiment, wherein the rotational speed of the drum cleaning roller during the post-jam process changes dependently on the environment;

DETAILED DESCRIPTION OF THE PREFERRED EMBODIMENTS

Figure 1:
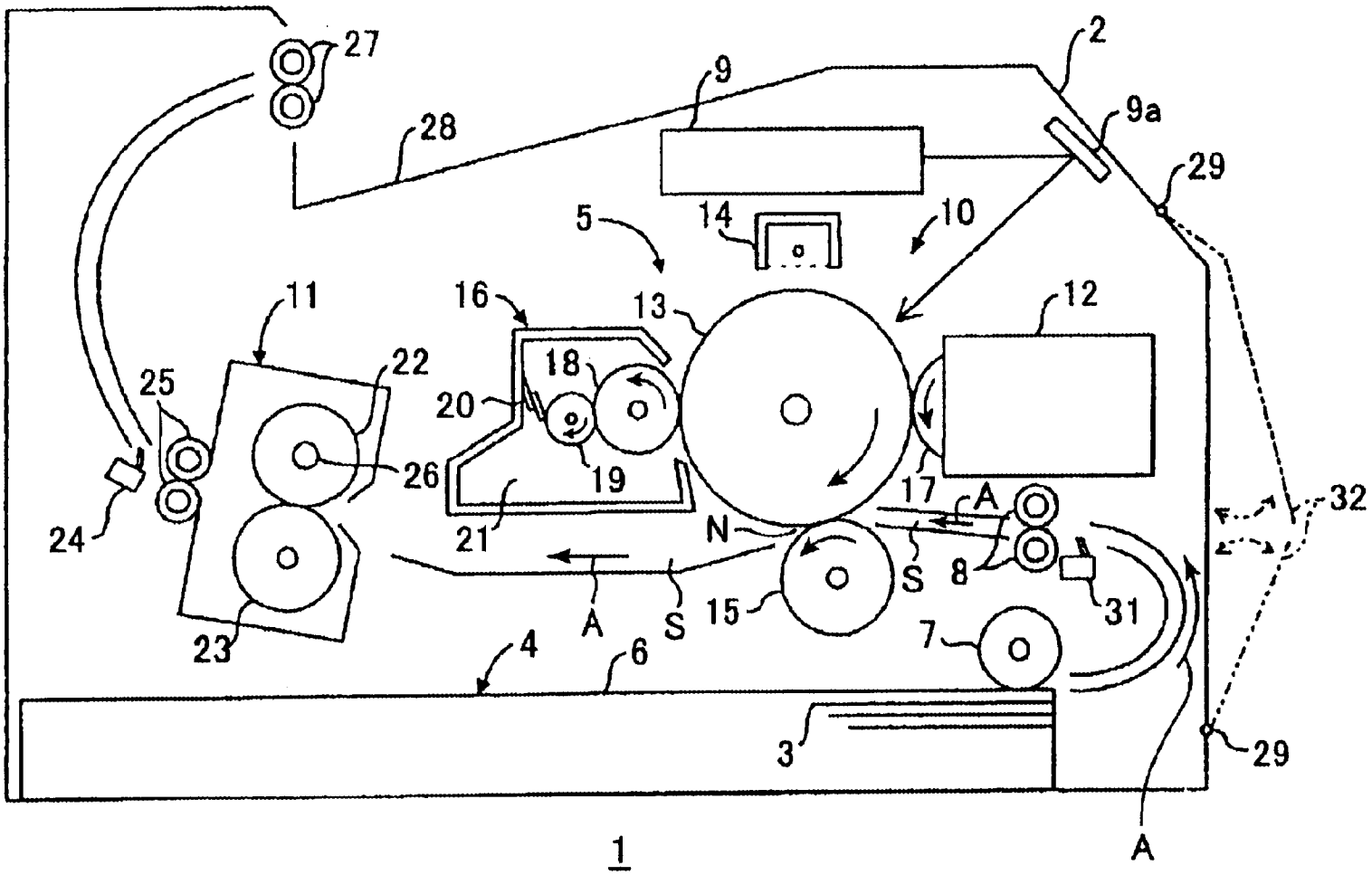
FIG. 1 is a cross-sectional view showing an essential part of a laser printer 1 that serves as an image forming apparatus according to a first embodiment.

An image forming apparatus according to preferred embodiments of the present invention will be described while referring to the accompanying drawings wherein like parts and components are designated by the same reference numerals to avoid duplicating description.

<First Embodiment>

An image forming apparatus according to a first embodiment of the present invention will be described below with reference to FIGS. 1–7.

FIG. 1 is a cross-sectional view showing an essential part of a laser printer 1 that serves as the image forming apparatus according to the first embodiment.

As shown in FIG. 1, the laser printer 1 includes a main body casing 2, in which a sheet feeding unit 4 and an image forming unit 5 are mounted. The sheet feed unit 4 is for is supplying sheets of paper 3 to the image forming unit 5. The sheets of paper 3 serve as recording media to be printed with visible toner images. The image forming unit 5 is for printing visible toner images onto the sheets of paper 3.

As shown in FIG. 1, the sheet feeding unit 4 is disposed at a bottom portion of the casing 2. The sheet feeding unit 4 includes: a sheet supply tray 6, a sheet supply roller 7, a pair of register rollers 8, and a register sensor 31. The sheet supply tray 6 is mounted detachably to the casing 2.

The sheet supply roller 7 is located within the casing 2 above one end of the sheet supply tray 6 when the sheet supply tray 6 is properly mounted within the casing 2. The register rollers 8 are provided downstream from the sheet supply roller 7 with respect to a predetermined sheet transport direction A, which is indicated by an arrow A in the drawing of FIG. 1.

One sheet at a time is fed out by the sheet feed roller 7 from the sheet supply tray 6 and is supplied to the register rollers 8. The sheet 3 fed out from the sheet supply tray 6 has its front edge aligned by the register rollers 8 and then is transported to the image forming unit 5. Thus, a sheet of paper 3 is transported along a predetermined sheet transport path S in the sheet transport direction A indicated by an arrow in the figure.

The register sensor 31 is provided near to the register rollers 8 and in the upstream side of the register rollers 8 in the sheet transport direction A. The register sensor 31 includes an actuator, and detects whether a sheet of paper 3 is brought into contact with the actuator, thereby detecting whether the sheet of paper 3 is jammed in the processing portion 10. The register sensor 31 is in an off-state while no sheet of paper 3 contacts the actuator, and is in an on-state while some sheet of paper 3 is contacting the actuator.

As shown in FIG. 1, the image forming unit 5 includes a scanner unit 9, a processing unit 10, and a fixing unit 11.

The scanner unit 9 is provided in the upper portion within the casing 2. The scanner unit 9 includes: a laser emitting portion (not shown in the drawing); a reflection mirror 9*a*; a polygon mirror (not shown); and a plurality of lenses (not shown). The laser emitting portion is for modulating a laser beam based on image data and for emitting the modulated laser beam. The laser beam emitted from the laser emitting portion reflects at the polygon mirror (not shown), passes through the plurality of lenses (not shown), and reflects at the reflection mirror 9*a*. The laser beam is finally irradiated across the surface of a photosensitive drum 13 to perform a high-speed scanning operation. The photosensitive drum 13 serves as an image bearing body in the processing portion 10.

As shown in FIG. 1, the processing portion 10 is disposed below the scanner unit 9. The processing portion 10 includes: the photosensitive drum 13, a Scorotron charger 14, a transfer roller 15; a development cartridge 12; and a drum cleaning portion 16. The Scorotron charger 14 is for electrically charging the photosensitive drum 13. The transfer roller 15 is for transferring a toner image formed on the photosensitive drum 13 onto a sheet of paper 3 as described later.

The development cartridge 12 is detachably mounted to the casing 2. The development cartridge 12 has a developing roller 17, a toner box (not shown), a supply roller (not shown), and a layer-thickness regulating blade (not shown). The developing roller 17 is applied with a predetermined developing bias voltage from a developing bias applying circuit 62 (shown in FIG. 2).

The toner box in the developing cartridge 12 is filled with toner. Toner serves as developing agent. According to this embodiment, a nonmagnetic single component development agent is used as the toner. The toner has electrically insulating properties, and is adapted for being electrically charged to a positive polarity.

The developing roller 17 is disposed in confrontation with the supply roller (not shown), and is rotatable in a counterclockwise direction indicated by the arrow in the is figure. The development roller 17 has a metallic roller shaft covered by a roller portion that is made from a conductive material. A developing bias applying circuit 62 (shown in FIG. 2) applies the developing roller 17 with a predetermined developing bias. When toner is supplied to the development roller 17 by rotation of the toner supply roller (not shown), the toner is electrically charged to a positive polarity due to friction between the toner supply roller and the development roller 17, while being supplied onto the development roller 17. In association with rotation of the development roller 17 relative to the layer-thickness regulating blade (not shown), the toner on the development roller 17 is regulated to a toner layer of a predetermined small thickness on the developing roller 17.

The photosensitive drum 13 is rotatably mounted in the casing 2. A main motor 54 (shown in FIG. 2) is provided to drive the photosensitive drum 13 to rotate in a clockwise direction indicated by an arrow in FIG. 1. The development cartridge 12 is detachably mounted to the casing 2 at a position that the photosensitive drum 13 becomes in contact with the development roller 17. Although not shown in the drawing, the photosensitive drum 13 is constructed from: a sleeve (drum body) and a photosensitive layer formed on the outer surface of the sleeve. The sleeve is electrically grounded. The photosensitive layer is formed from a material that can be electrically charged to a positive polarity.

The Scorotron charger 14 is mounted in the casing 2 at a location that is above the photosensitive drum 13 and that is separated from the photosensitive drum 13 by a predetermined distance. The Scorotron charger 14 is a positively charging type. The Scorotron charger 14 includes a tungsten wire or other type charge wire, and generates corona discharge therefrom. The Scorotron charger 14 is configured so as to be capable of electrically charging the surface of the photosensitive drum 13 uniformly to a positive polarity. The charging by the Scorotron charger 14 is controlled by a charging controlling circuit 59 (shown in FIG. 2) as will be described later.

After the Scorotron charger 14 uniformly charges the surface of the photosensitive drum 13 to a positive polarity, the scanner unit 9 executes the high-speed scanning operation to expose the surface of the photosensitive drum 13 with a laser beam that is modulated by image data. When the electrically-charged surface of the photosensitive drum 13 is exposed to the laser beam, the electric potential at exposed portions is reduced to an electric potential lower than at non-exposed portions and at the developer roller 17. Thus, an electrostatic latent image is formed on the surface of the photosensitive drum 13.

As the development roller 17 rotates, the positively charged toner borne on the development roller 17 is brought into contact with the surface of photosensitive drum 13. As a result, the toner is supplied only to those areas that have their electric potential reduced according to the electrostatic latent image. Thus, the toner is selectively supplied to the surface of the photosensitive drum 13 to develop the electrostatic latent image into a visible toner image.

The transfer roller 15 is mounted in the casing 2 at a position below the photosensitive drum 13 and in confrontation with the photosensitive drum 13. The transfer roller 15 has a metallic roller shaft covered with a roller portion made of a resilient conductive material. The transfer roller 15 is driven by the photosensitive drum 13 to rotate in the counterclockwise direction. A predetermined transfer position N is defined on the sheet transport path S where the photosensitive drum 13 abuts against the transfer roller 15. The transfer position N is disposed downstream from the register rollers 8 along the sheet transport path S in the sheet transport direction A. When the sheet of paper 3 is transported by the register rollers 8 and reaches the transfer position N, the sheet of paper 3 passes between the photosensitive drum 13 and the transfer roller 15. At this time, the paper is brought into contact with the surface of the photosensitive drum 13. Accordingly, the visible toner image borne on the photosensitive drum 13 is transferred from the photosensitive drum 13 onto the sheet of paper 3.

More specifically, at the time of transferring a toner image onto a sheet of paper 3, a transfer bias applying circuit 60 (which will be described later with reference to FIG. 2) applies the transfer roller 15 with a predetermined transfer bias voltage with respect to the photosensitive drum 13. The polarity of the transfer bias voltage is negative, and therefore is opposite to the polarity of the positively-charged toner. Accordingly, the positively-charged toner borne on the photosensitive drum 13 is electrostatically attracted in a direction toward the transfer roller 15.

It is noted that a reverse transfer bias applying circuit 61 (shown in FIG. 2) applies the transfer roller 15 with a predetermined reverse transfer bias voltage during a cleaning process (post-jam process), which is executed after the jam of the sheet 3 is cleared up. The polarity of the reverse transfer bias voltage is positive, and therefore is the same as the polarity of the positively-charged toner. Accordingly, it is possible to prevent the residual toner residing on the photosensitive drum 13 from being attached onto the transfer roller 15 after the jam of the sheet 3 is cleared up.

The drum cleaning portion 16 includes; a drum cleaning roller 18 (cleaning roller), a secondary cleaning roller 19, and a cleaning blade 20, which are enclosed in a waste toner tank 21. The drum cleaning portion 16 is disposed on the downstream side of the transfer roller 15 and on the upstream side of the Scorotron charger 14 with respect to the rotating direction of the photosensitive drum 13.

The drum cleaning roller 18 is provided in confrontation with and in contact with the photosensitive drum 13. The drum cleaning roller 18 rotates in a counterclockwise direction as indicated by an arrow in the drawing of FIG. 1. The drum cleaning roller 18 has a roller shaft covered with a roller portion made of electrically-conductive resilient material. Accordingly, the outer surface of the drum cleaning roller 18 is electrically conductive and is resilient. A cleaning bias applying circuit 58 (which will be described later with reference to FIG. 2) applies the drum cleaning roller 18 with a predetermined cleaning bias voltage with respect to the photosensitive drum 13, to thereby establish a predetermined electric potential between the photosensitive drum 13 and the drum cleaning roller 18. The polarity of the cleaning bias voltage is negative, and therefore is opposite to the polarity of the positively-charged toner.

The drum cleaning roller 18 is in confrontation with and in contact with the secondary cleaning roller 19 at a position that is opposite to the position where the drum cleaning roller 18 is in confrontation with and in contact with the photosensitive drum 13. In other words, the secondary cleaning roller 19 is located on the downstream side of the photosensitive drum 13 with respect to the rotating direction of the drum cleaning roller 18. The secondary cleaning roller 19 is made of metallic roller, and is applied with a predetermined bias voltage with respect to the drum cleaning roller 18.

The secondary cleaning roller 19 is in confrontation with and in contact with the cleaning blade 20 at a position that is opposite to the position where the secondary cleaning roller 19 is in confrontation with and in contact with the drum cleaning roller 18. In other words, the cleaning blade 20 is located on the downstream side of the drum cleaning roller 18 with respect to the rotating direction of the secondary cleaning roller 19. The cleaning blade 20 is constructed from a thin-plate shaped blade for scraping off toner that is attached to the surface of the secondary cleaning roller 19.

With this structure, the residual toner, residing on the photosensitive drum 13 after a toner image is transferred onto the sheet of paper 3, is electrically captured by the drum cleaning roller 18 when the toner becomes in confrontation with the drum cleaning roller 18. In association with the rotation of the drum cleaning roller 18, the toner thus captured on the drum cleaning roller 18 is brought into confrontation with the secondary cleaning roller 19. As a result, the toner is electrically captured by the secondary cleaning roller 19, and is thereafter scraped off by the cleaning blade 20 and collected in the waste toner tank 21.

As shown in FIG. 1, the fixing unit 11 is disposed at a position downstream from the processing portion 10 along the sheet transport path S in the sheet transport direction A. The fixing unit 11 includes: a thermal roller 22, a pressing roller 23, a discharge sensor 24, and a pair of transport rollers 25. The pressing roller 23 is pressed against the thermal roller 22. The pair of transport rollers 25 are disposed downstream of the rollers 22 and 23 with respect to the sheet transport direction A.

The thermal roller 22 is made of metal, and encloses therein a heater 26 for heating the roller 22. The pressing roller 23 is disposed confronting the thermal roller 22 and pressing against the thermal roller 22. The thermal roller 22 is for thermally fixing toner onto a sheet of paper 3 as the sheet of paper 3 passes between the pressing roller 23 and the thermal roller 22.

The pair of transport rollers 25 are provided downstream from the fixing unit 11 in the sheet transport direction A. The sheet of paper 3 is therefore transported by the transport rollers 25 to a pair of discharge rollers 27. When the sheet of paper 3 reaches the pair of discharge rollers 27, the sheet of paper 3 is discharged by the discharge rollers 27 onto a discharge tray 28 that is provided on the upper surface of the casing 2. The discharge sensor 24 is provided downstream from the transport rollers 25, and detects discharge of the sheet of paper 3.

A pair of open/close covers 32 are provided on the front side of the casing 2, and are openable and closable as indicated by dot-and-chain lines in FIG. 1. More specifically, a pair of hinge portions 29 are provided to serve as fulcrums to open and close the open/close covers 32. The hinge portions 29 are provided on the upper and lower portions of the casing 2 on its front side. When a sheet of paper 3 is jammed in the processing portion 10, a user opens the open/close covers 32, and removes the sheet of paper 3 outside the laser printer 1, thereby clearing up the jam.

Figure 2:
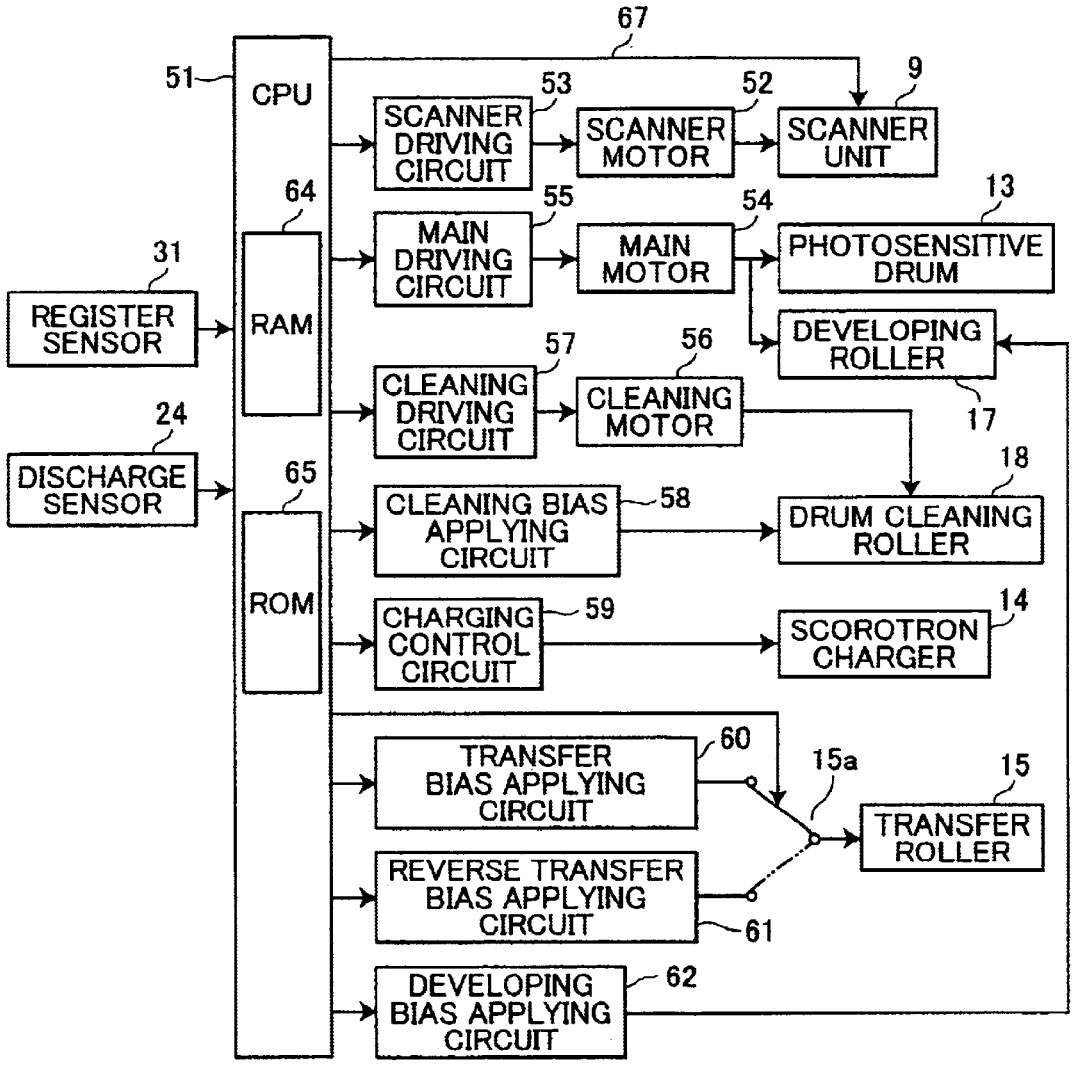
FIG. 2 is a block diagram of a control system for a processing portion in the laser printer of FIG. 1.

FIG. 2 is a block diagram of the control system for the processing portion 10. As shown in FIG. 2, in the laser printer 1, a CPU 51 is connected to: the register sensor 31 and the discharge sensor 24. The CPU 51 is further connected to: a laser emitting portion (not shown) in the scanner unit 9; a scanner driving circuit 53; a main driving circuit 55; a cleaning driving circuit 57; a cleaning bias applying circuit 58; a charging control circuit 59; a transfer bias applying circuit 60; a reverse transfer bias applying circuit 61; and a developing bias applying circuit 62. The CPU 51 controls the laser emitting portion (not shown) in the scanner unit 9 by issuing a control signal 67. The scanner driving circuit 53 is for driving and controlling the scanner motor 52. The main driving circuit 55 is for driving and controlling the main motor 54. The cleaning driving circuit 57 is for driving and controlling the cleaning motor 56. The cleaning bias applying circuit 58 is for applying a cleaning bias voltage to the drum cleaning roller 18. The charging control circuit 59 is for controlling the Scorotron charger 14 to electrically charge the photosensitive drum 13. The transfer bias applying circuit 60 is for applying a transfer bias voltage to the transfer roller 15. The reverse transfer bias applying circuit 61 is for applying a reverse transfer bias voltage to the transfer roller 15. The developing bias applying circuit 62 is for applying a developing bias voltage to the developing roller 17.

The CPU 51 is provided with a RAM 64 and ROM 65, and executes control of the respective components in the laser printer 1. The RAM 64 temporally stores numerical values, which are supplied from the register sensor 31, the discharge sensor 24, and the like and which are used to drive and control the respective components. The ROM 65 is prestored with several types of control programs, such as a main drive control program and a transfer jam control program that is executed after a jam has occurred. These programs are executed by the CPU 51 to control: the control signal 67, the scanner driving circuit 53, the main driving circuit 55, the cleaning driving circuit 57, the cleaning bias applying circuit 58, the charging control circuit 59, the transfer bias applying circuit 60, the reverse transfer bias applying circuit 61, and the developing bias applying circuit 62.

The scanner driving circuit 53 is connected to the scanner motor 52, which is in turn connected to the polygon mirror (not shown) mounted in the scanner unit 9. During the process for image formation, the CPU 51 controls the scanner motor 52, via the scanner driving circuit 53, to drive the scanner motor 52 and to stop the scanner motor 52 according to the main drive control program stored in the ROM 65. Similarly, the CPU 51 issues, based on print data, the control signal 67 to control the laser emitting portion (not shown) to emit a laser beam and to stop emitting the laser beam according to the main drive control program stored in the ROM 65. Accordingly, each component in the scanner unit 9 is controlled according to the main drive control program to emit the laser beam and to scan the laser beam at a high speed during the image forming process.

The main driving circuit 55 is connected with the main motor 54, which in turn is connected to the photosensitive drum 13 and the developing roller 17 with a train of gears (not shown). During the image forming process, the CPU 51 controls to drive and to stop driving the main motor 54, via the main driving circuit 55, according to the main drive control program stored in the ROM 65. Accordingly, during the image forming process, the photosensitive drum 13 and the developing roller 17 are controlled to be rotationally driven and to stop according to the main drive control program.

The cleaning driving circuit 57 is connected to the cleaning motor 56, which in turn is connected to the drum cleaning roller 18 via a train of gears (not shown). During the image forming process, the CPU 51 controls to drive and to stop driving the cleaning motor 56 via the cleaning driving circuit 57 according to the main drive control program stored in the ROM 65. Accordingly, during the image forming process, the drum cleaning roller 18 is controlled to be rotationally driven and to stop according to the main drive control program.

The cleaning bias applying circuit 58 is connected to the roller shaft of the drum cleaning roller 18. During the image forming process, the CPU 51 controls to turn on and turn off the cleaning bias applied to the drum cleaning roller 18 via the cleaning bias applying circuit 58 according to the main drive control program.

The charging control circuit 59 is connected to the Scorotron charger 14. During the image forming process, the CPU 51 controls to turn on and turn off the charging by the Scorotron charger 14 via the charging control circuit 59 according to the main drive control program.

The transfer bias applying circuit 60 and the reverse transfer bias applying circuit 61 are connected to the roller shaft of the transfer roller 15 via a switch 15*a*. The CPU 51 is connected to the switch 15*a*. The CPU 51 controls the switch 15*a* to selectively connect either one of the transfer bias applying circuit 60 and the reverse transfer bias applying circuit 61 to the roller shaft of the transfer roller 15. The transfer bias applying circuit 60 is for applying the transfer roller 15 with a transfer bias voltage, whose polarity is opposite to that of the positively-charged toner. The reverse transfer bias applying circuit 61 is for applying the transfer roller 15 with a reverse transfer bias voltage, whose polarity is opposite to the transfer bias voltage and therefore is the same as that of the positively-charged toner.

During the image forming process, according to the main drive control program, the CPU 51 controls the switch 15*a* to connect the transfer bias applying circuit 60 to the roller shaft of the transfer roller 15, and controls to turn on and off the transfer bias applied to the transfer roller 15 via the transfer bias applying circuit 60.

When a sheet of paper 3 is jammed, according to the transfer jam control program, the CPU 51 controls the switch 15*a* to connect the reverse transfer bias applying circuit 61 to the roller shaft of the transfer roller 15, and controls to turn on and turn off the reverse transfer bias applied to the transfer roller 15 via the reverse transfer bias applying circuit 61.

The developing bias applying circuit 62 is connected to the roller shaft of the developing roller 17. During the image forming process, the CPU 51 controls to turn on and off the developing bias applied to the developing roller 17 via the developing bias applying circuit 62 according to the main drive control program.

With this configuration, the laser printer 1 executes a printing process according to the main drive control program during the normal printing time, that is, when no jam of a sheet of paper 3 is detected. When a sheet of paper 3 is jammed in the processing portion 10 at some location between the photosensitive drum 13 and the transport rollers 25, the transfer jam control program is executed.

Next will be described, with reference to the flowchart of FIG. 3, the control process executed by the processing portion 10 according to the main drive control program and to the transfer jam control program.

It is noted that "pass time T0" is defined as a period of time required from when a leading edge of a sheet of paper 3 passes by the register sensor 31 until a trailing edge of the same sheet of paper 3 passes by the register sensor 31 during a normal sheet-conveying process, that is, when the sheet of paper 3 is not jammed.

A "normal rotational-speed A0" is defined as a rotational speed, at which the drum cleaning roller 18 should be rotated during the normal printing process, that is, when the sheet of paper 3 is not jammed. A "first rotational-speed A1" is defined as another rotational speed, at which the drum cleaning roller 18 should be rotated during a cleaning process. It is noted that when a sheet of paper 3 is jammed, the cleaning process is executed after the jam is cleared up by the user removing the paper 3 out of the printer 1. The amount of the first rotational-speed A1 is previously determined as a value higher than the normal rotational-speed A0. It is noted that the amount of the first rotational-speed A1 can be set to a desired value, higher than the normal rotational-speed A0, dependently on the configuration of the laser printer 1 and on the printing condition.

An "accumulated printed number N1" is defined as the total number of sheets that the printer 1 has printed from the time when the developing cartridge 12 has been replaced by a new one at the latest.

Figure 3:
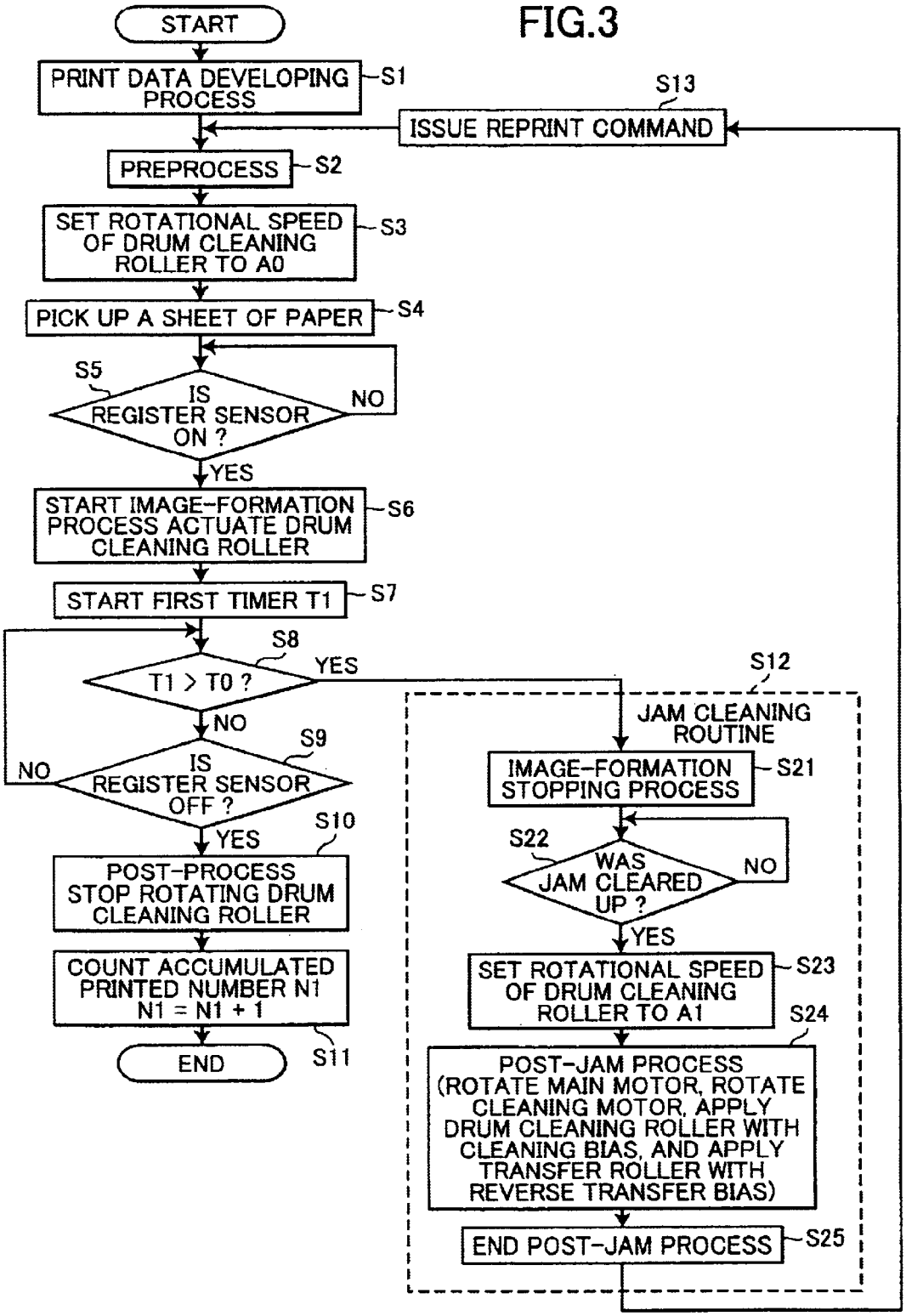
FIG. 3 is a flowchart of a control process according to the first embodiment, wherein during the post-jam process, the drum cleaning roller is rotated at a rotational speed different from a normal rotational speed.

As shown in FIG. 3, when the printing process is started, print data is first developed in S1. Next, in S2, a preprocessing is executed to control the fixing temperature of the heat roller 22, to control the charging of the photosensitive drum 13, and to control the switch 15*a* to connect the transfer bias applying circuit 60 to the transfer roller 15. In S3, the rotational number of the drum cleaning roller 18 is set to the normal rotational-speed A0. That is, the CPU 51 sets the cleaning driving circuit 57 to drive the cleaning motor 56 to rotate the drum cleaning roller 18 at the normal rotational-speed A0.

Thereafter, a sheet of paper 3 is picked up in S4. The program then waits while the register sensor 31 is being off (no in S5). When the register sensor 31 is turned on (yes in S5), the image formation process is started in S6. That is, the CPU 51 starts controlling the scanner driving circuit 53 and the main driving circuit 55 to drive the scanner motor 52 and the main motor 54, starts controlling the charging control circuit 59 to drive the Scorotron charger 14, and starts controlling the transfer bias applying circuit 60 and the developing bias applying circuit 62 to apply bias voltages to the transfer roller 15 and the developing roller 17, respectively. Also in S6, the drum cleaning roller 18 is actuated. That is, the CPU 51 starts controlling the cleaning driving circuit 57 to drive the cleaning motor 56 to rotate the drum cleaning roller 18 at the normal rotational-speed A0, and starts controlling the cleaning bias applying circuit 58 to apply a cleaning bias voltage to the drum cleaning roller 18.

Next, a first timer T1 starts counting time in S7. Next, in S8, it is judged whether the first timer T1 exceeds the pass time T0. While the first timer T1 does not exceed the pass time T0 (no in S8), the state of the register sensor 31 is judged. While the register sensor 31 is being on (no in S9), it is repeatedly judged in S8 whether the first timer T1 exceeds the pass time T0. When the register sensor 31 is turned off while the first timer T1 does not exceed the pass time T0, that is, when the register sensor 31 is turned off simultaneously when the first timer T1 reaches the pass time T0 (no in S8 and yes in S9), a post-process is executed in S10 to turn off the several motors, to stop applying the several bias voltages, and to stop rotating the drum cleaning roller 18. The accumulated printed number N1 is incremented by one (1) in S11, and the process ends.

The CPU 51 executes the above-described processes of S1–S11 according to the main driving control program when a sheet of paper 3 is not jammed in the processing portion 10. During the above-described processes, the preprocessing is executed, and the drum cleaning roller 18 is set to rotate at the normal rotational-speed A0. Then, one sheet of paper 3 is conveyed to the processing portion 10. The image forming process is started, and a cleaning process is executed by the drum cleaning roller 18. After an image is transferred onto the sheet of paper 3, the post-process is executed, and the accumulated printed number N1 is incremented by one (1).

It is noted that the process of FIG. 3 is directed to the case where one sheet of paper 3 is printed at a time. However, in order to execute continuous printing, for example, the process of S10 may be modified not to stop rotating the drum cleaning roller 18. In this case, the drum cleaning roller 18 will continuously rotate while a plurality of images are being printed successively on a plurality of sheets of paper 3.

On the other hand, when the first timer T1 exceeds the pass time T0 (yes in S8) while the register sensor 31 is being on (no in S9), it is determined that the sheet of paper 3 is jammed because the sheet of paper 3 keeps staying in the processing portion 10 even when the predetermined pass time T0 elapses after the sheet of paper 3 has reached the processing portion 10. Accordingly, the CPU 51 executes a jam cleaning routine of S12 according to the transfer jam control program.

During the jam cleaning routine of S12, an image-formation stopping process is first executed in S21 to stop driving the main motor 54 and the cleaning motor 56, to stop charging operation by the Scorotron charger 14, and to stop application of the transfer bias voltage and of the developing bias voltage. Then, the program waits (no in S22) until the jam of the sheet of paper 3 is cleared up. It is noted that the CPU 51 judges that the jam of the sheet of paper 3 is cleared up when the register sensor 31 is turned off when the user removes the sheet of paper 3 outside the printer 1 by opening the open/close cover 32. When the jam of the sheet of paper 3 is cleared up (yes in S22), the rotational speed of the drum cleaning roller 18 is set to the first rotational-speed A1 in S23. That is, the CPU 51 sets the cleaning driving circuit 57 to drive the cleaning motor 56 to rotate the drum cleaning roller 18 at the first rotational-speed A1.

Next, in S24, a post-jam process is executed. During the post-jam process, the CPU 51 drives the main motor 54, drives the cleaning motor 56 to rotate the drum cleaning motor 18 at the first rotational-speed A1, and applies the drum cleaning roller 18 with the cleaning bias voltage. The CPU 51 further controls the switch 15*a* to connect the reverse transfer bias applying circuit 61 to the transfer roller 15, and controls the reverse transfer bias applying circuit 61 to apply the transfer roller 15 with the reverse transfer bias voltage.

When a predetermined time (predetermined cleaning time) has elapsed after the post-jam process is started, the post-jam process is ended in S25. That is, driving of the main motor 54 and of the cleaning motor 56 is stopped, and the application of the reverse transfer bias and the cleaning bias is turned off. In this way, the jam-cleaning routine of S12 is ended.

It is noted that in S24, the CPU 51 judges whether the predetermined cleaning time has elapsed after the post-jam process is started. The length of the predetermined cleaning time is equal to or longer than a from-development-to-cleaning period of time that is required by a portion of the photosensitive drum 13 to move from a developing position where the portion contacts the developing roller 17 to a cleaning position where the portion contacts the drum cleaning roller 18. It is preferable that the predetermined cleaning time should be a total sum of the from-development-to-cleaning time period and a time period required by the photosensitive drum 13 to rotate some integral number's turns, that is, to rotate by an angle equal to some integral multiple of 360 degrees. By rotating the photosensitive drum 13 for this time period to during the post-jam process, it is ensured that the drum cleaning roller 18 can remove toner sufficiently uniformly from the entire surface of the photosensitive drum 13.

After the jam-cleaning routine of S12 is ended, a command to reprint is issued in S13, and the program returns to the preprocess of S2.

In this way, when a sheet of paper 3 is jammed while being supplied between the photosensitive drum 13 and the transfer roller 15, the sheet of paper 3 is first removed, thereby clearing up the jam. Then, the development jam control program is executed to rotate the drum cleaning roller 18 at the rotational speed A1 which is higher than the normal rotational speed A0 and to supply the transfer roller 15 with the reverse bias voltage whose polarity is the same as that of the charged toner.

Figure 4:
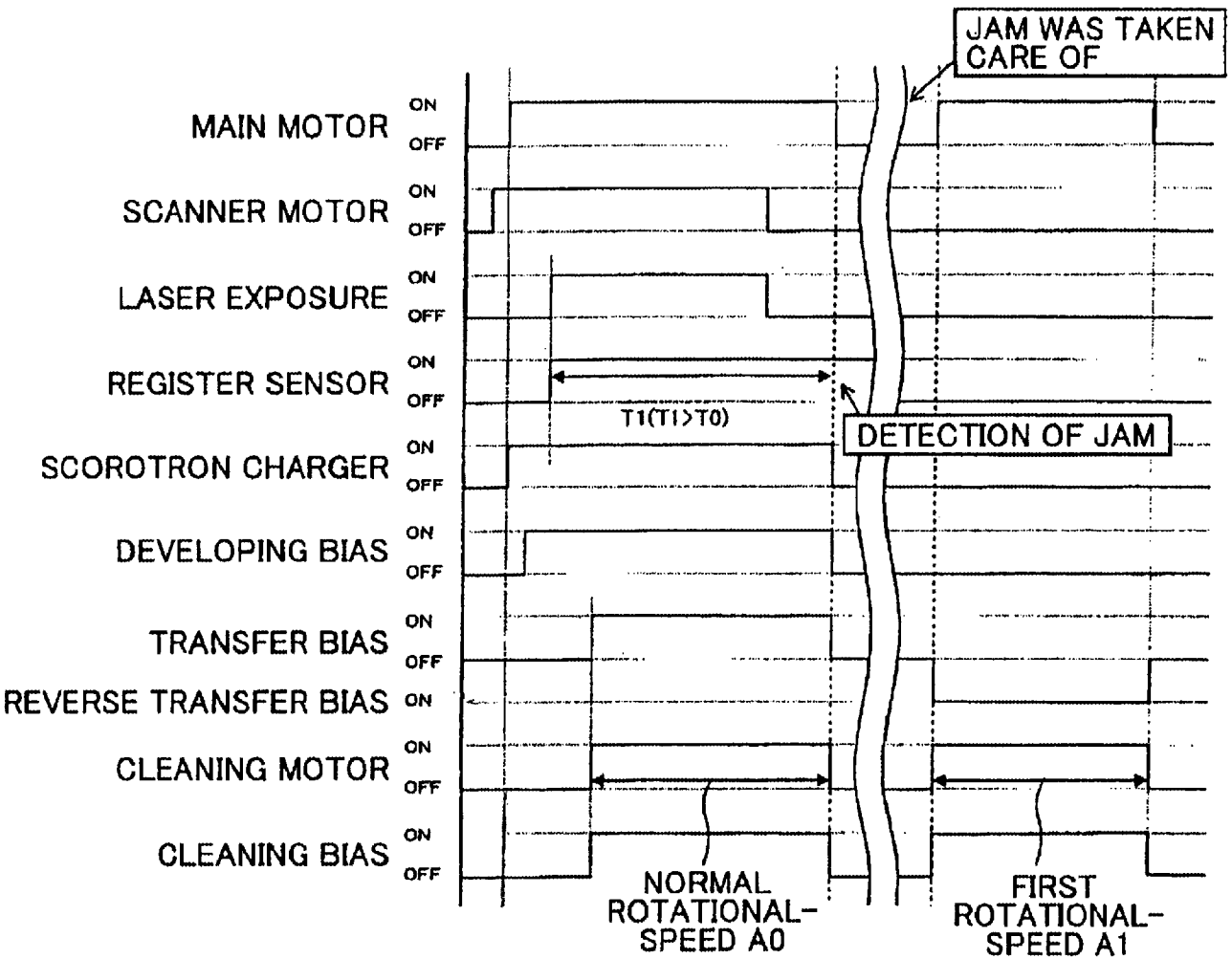
FIG. 4 shows timing charts of respective parts according to the control process of FIG. 3.

FIG. 4 is a timing chart showing how the respective components are driven and the respective bias voltages are applied when a sheet of paper 3 is jammed in the processing portion 10.

As shown in FIG. 4, after a printing process is started, the scanner motor 52 and main motor 54 are driven, and the Scorotron charger 14 and the developing bias are turned on. Then, exposure by the laser beam is started on the photosensitive drum 13. When one sheet of paper 3 is supplied to the processing portion 10, the register sensor 31 is turned on. Then the cleaning motor 56 drives the drum cleaning roller 18 to rotate at the normal rotational-speed A0, and the transfer roller 15 and the drum cleaning roller 18 are applied with the transfer bias voltage and the cleaning bias voltage, respectively. If the register sensor 31 is not turned off even when the pass time T0 elapses after the register sensor 31 has been turned on, jam of the sheet of paper 3 is detected. Accordingly, driving of the main motor 54 and the cleaning motor 56 is stopped. The charging by the Scorotron charger 14, the application of the transfer bias to the transfer roller 15, the application of the developing bias to the developing roller 17, and the application of the cleaning bias to the drum cleaning roller 18 is turned off. After the sheet of paper 3 is removed from the printer 1 and the condition of the printer 1 is restored, the main motor 54 is driven again to rotationally drive the photosensitive drum 13, and a reverse transfer bias voltage is applied to the transfer roller 15. The cleaning motor 56 is driven to rotate the drum cleaning roller 18 at the first rotational-speed A1, and the drum cleaning roller 18 is applied with the cleaning bias voltage.

In this way, after the jam is cleared up, the drum cleaning roller 18 is rotated at the first rotational-speed A1, which is higher than the normal rotational-speed A0, and the transfer roller 15 is applied with the reverse transfer bias voltage, whose polarity is the same as that of the charged toner. When the predetermined cleaning time period elapses after the post-jam process is started, the driving of the main motor 54 and the cleaning motor 56 is stopped, and the application of the reverse transfer bias and the cleaning bias is turned off.

According to the above-described control process, the drum cleaning roller 18 is driven in the normal actuating condition (that is, normal rotational-speed A0) during the normal image forming process, that is, when the sheet of paper 3 is not jammed. During such a normal printing process, the drum cleaning roller 18 will not be actuated in the condition (that is, first rotational-speed A1) that is determined in correspondence with the post-jam process. It is possible to prevent the drum cleaning roller 18 from excessively sliding against the photosensitive drum 13 during the normal image-forming process. It is possible to effectively prevent the image quality from being lowered and to prevent the life of the photosensitive drum 13 from being shortened.

On the other hand, when jam occurs against the sheet of paper 3, according to the transfer jam control program, after the sheet of paper 3 is removed and the jam is cleared up, the drum cleaning roller 18 is rotated, during the post-jam process, in the other condition, that is, at the first rotational-speed A1 higher than the normal rotational-speed A0. Even if a large amount of toner remains on the photosensitive drum 13 due to the sheet jam, the high-speedily rotating drum cleaning roller 18 can properly collect the toner. Additionally, according to the transfer jam control program, after the jam is cleared up, the transfer roller 15 is applied with a reverse bias voltage whose polarity is the same as that of toner. It is therefore possible to prevent the large amount of toner, which remains on the photosensitive drum 13, from being attached onto the transfer roller 15. It is ensured that the drum cleaning roller 18 can collect the remaining large amount of toner.

(First Modification)

The charging amount of toner decreases as time passes. Accordingly, if it takes a long period of time to take care of the jam after the jam is detected, even when the drum cleaning roller 18 is applied with the sufficient amount of cleaning bias, the drum cleaning roller 18 will possibly collect toner insufficiently due to the lowering of the toner-charging amount. To solve this problem, according to the transfer jam control program of this modification, if a period of time longer than a predetermined period of time elapses after the jam is detected, after the jam is cleared up, the Scorotron charger 14 is turned ON to electrically charge toner again, and the post-jam process is executed thereafter.

FIG. 5 shows the control processes according to this modification. In FIG. 5, the same processes as those in FIG. 3 are indicated by the same references, and therefore description of them will be omitted.

It is noted that a "leave time T3" is a period of time defined as a reference used to judge whether the Scorotron charger 14 should be turned ON again during the jam cleaning routine of S12. In this example, the leave time T3 is set to five hours, but can be set to another appropriate value dependently on the characteristics of toner.

According to this modification, during the jam cleaning routine of S12, after the image forming stopping process is executed in S21 in the same manner as in FIG. 3, a second timer T2 starts counting time in S31. Then, the processes of S22–S23 are executed in the same manner as in FIG. 3. Then, it is judged in S32 whether or not the second timer T2 exceeds the leave time T3. If the second timer T2 does not exceed the leave time T3 (no in S32), the processes of S24 and S25 are executed in the same manner as in FIG. 3.

On the other hand, if the second timer T2 exceeds the leave time T3 (yes in S32), the Scorotron charger 14 is turned on in S33. That is, the CPU 51 controls the charging control unit 59 to turn on the Scorotron charger 14. Thereafter, the processes of S24–S25 are executed in the same manner as described above. It is noted that when the Scorotron charger 14 is turned ON in S33, the Scorotron charger 14 is turned off after the process of S25 is completed.

With this configuration, if it takes the predetermined leave time T3 or longer to take care of the jam, the Scorotron charger 14 is turned ON to electrically charge the toner, whose charging amount has been reduced due to the elapse of such a long time. This ensures that the drum cleaning roller 18 properly collects toner.

(Second Modification)

According to this modification, a plurality of different rotational speeds are set for the drum cleaning roller 18. One of the plurality of rotational speeds is set dependently on the accumulated printed number N1.

FIG. 6 shows the control processes according to this modification. In FIG. 6, the same processes as those in FIG. 3 are indicated by the same references, and therefore description thereof will be omitted.

According to the present modification, after the jam is cleared up, one of a plurality of cleaning processes is selected. The plurality of cleaning processes are different from one another in their rotational-speeds at which the drum cleaning roller 18 is rotated during the post-jam process of S24. It is noted that "second rotational-speed A2", "third rotational-speed A3", "fourth rotational-speed A4", and "fifth rotational-speed A5" are rotational speeds, which are prepared for the drum cleaning roller 18, and which satisfy the following relationship: A0<A2<A3<A4<A5.

It is also noted that "first printed number M1", "second printed number M2", and "third printed number M3" are the number of printed sheets used as references to select one of the plurality of cleaning processes. It is noted that the first printed number M1, the second printed number M2, and the third printed number M3 satisfy the following inequality: M1<M2<M3. In this example, M1, M2, and M3 are set to 1,000, 3,000, and 6,000, respectively, but may be set to other appropriate values dependently on the characteristics of toner and the like.

In this modified jam cleaning routine of S12, the processes of S21 and S22 are executed in the same manner as in FIG. 3. When the jam is cleared up (yes in S22), it is judged in S41 whether or not the accumulated printed number N1 exceeds the first printed number M1. If the accumulated printed number N1 exceeds the first printed number M1 (yes in S41), it is judged in S42 whether or not the accumulated printed number N1 exceeds the second printed number M2. If the accumulated printed number N1 exceeds the second printed number M2 (yes in S42), it is judged in S43 whether or not the accumulated printed number N1 exceeds the third printed number M3. If the accumulated printed number N1 exceeds the third printed number M3 (yes in S43), the rotational speed of the drum cleaning roller 18 is set to the fifth rotational-speed A5 in S44. That is, the CPU 51 sets the cleaning driving circuit 57 to drive the cleaning motor 56 to rotate the drum cleaning roller 18 at the fifth rotational-speed A5. Then, the post-jam process is executed in S24 in the same manner as in FIG. 3 except that the drum cleaning roller 18 rotates at the fifth rotational-speed A5. After the predetermined cleaning time elapses after the start of the post-jam process, the post-jam process is ended in S25 in the same manner as in FIG. 3.

In this way, according to this modification, if the accumulated printed number N1 exceeds the third printed number M3, the cleaning motor 56 is driven in S24 at such a rotational number that rotates the drum cleaning roller 18 at the fifth rotational-speed A5.

On the other hand, if the accumulated printed number N1 does not exceed the first printed number M1 (no in S41) at the time when the jam is cleared up, the rotational speed of the drum cleaning roller 18 is set to the second rotational-speed A2 in S45. That is, the CPU 51 sets the cleaning driving circuit 57 to drive the cleaning motor 56 to rotate the drum cleaning roller 18 at the second rotational-speed A2. Thereafter, the post-jam process is executed in S24 with the second rotational-speed A2, and is ended in S25.

On the other hand, when the accumulated printed number N1 exceeds the first printed number M1 (yes in S41) but does not exceed the second printed number M2 (no in S42), the rotational speed of the drum cleaning roller 18 is set to the third rotational-speed A2 in S46. That is, the CPU 51 sets the cleaning driving circuit 57 to drive the cleaning motor 56 to rotate the drum cleaning roller 18 at the third rotational-speed A3. Thereafter, the post-jam process is executed in S24 with the third rotational-speed A3 and is ended in S25.

On the other hand, when the accumulated printed number N1 exceeds the second printed number M2 (yes in S42) but does not exceed the third printed number M3 (no in S43), the rotational speed of the drum cleaning roller 18 is set to the fourth rotational-speed A4 in S46. That is, the CPU 51 sets the cleaning driving circuit 57 to drive the cleaning motor 56 to rotate the drum cleaning roller 18 at the fourth rotational-speed A4. Thereafter, the post-jam process is executed in S24 with the fourth rotational-speed A4 and is ended in S25.

As the number of printing executed by the printer 1 increases, toner and each component in the laser printer 1 is degraded and printing density increases. Accordingly, the amount of toner residing on the photosensitive drum 13 at the time of a sheet jam increases in accordance with the increase in the number of printing which the printer 1 has executed up to the time when the sheet jam occurs.

However, according to the transfer-jam control process of the present modification, the rotational speed of the drum cleaning roller 18 is properly set dependently on the number of printing executed until the time of sheet jam. Even when the amount of toner residing on the photosensitive drum 13 increases according to increase in the number of printing, by rotating the drum cleaning roller 18 at a higher speed, it is ensured that the drum cleaning roller 18 can sufficiently collect the residual toner from the photosensitive drum 13.

(Third Modification)

In this modification, the rotational speed of the drum cleaning roller 18 is controlled dependently on the environment where the laser printer 1 is located.

FIG. 7 shows the processes according to this modification. In FIG. 7, the same processes as those in FIG. 3 are indicated by the same references, and therefore description thereof will be omitted.

It is noted that "sixth rotational-speed A6", "seventh rotational-speed A7", and "eighth rotational-speed A8" are rotational speeds previously set for the drum cleaning roller 18 to satisfy the following relationship: A0<A8<A7<A6.

It is also noted that "high temperature-and-high humidity environmental value combination H/H" and "normal temperature-and-normal humidity environmental value combination N/N" are references used to judge the environment. In this example, the high temperature-and-high humidity environmental value combination H/H is a combination of temperature of 32° C. and humidity of 80%, and the normal temperature-and-normal humidity environmental value combination N/N is a combination of temperature of 23° C. and humidity of 50%. However, they may be set to other appropriate values dependently on the characteristic of toner and the like.

According to the present modification, in order to detect the values of temperature and humidity, a temperature/humidity sensor (not shown) is connected with the CPU 51. It is noted that the transfer roller 15 may be controlled at a constant electric current by the transfer bias applying circuit 60, and a voltage generated by the transfer roller 15 may be used to indicate the values of temperature and humidity. When the generated voltage is higher than some reference voltage value, it is known that the present environment (temperature/humidity combination) is lower than the normal temperature-and-normal humidity environmental value combination N/N. When the generated voltage is lower than some other reference voltage value, it is known that the present environment (temperature/humidity combination) is greater than the high temperature-and-high humidity environmental value combination H/H.

According to this modification, during the jam cleaning routine of S12, after the image formation stopping process of S21, when the jam of a sheet of paper 3 is cleared up in S22, it is judged in 551 whether or not the environment where the laser printer 1 is located exceeds the high temperature-and-high humidity environmental value combination H/H. It is noted that the environment is indicated by the temperature/humidity combination detected by the temperature/humidity sensor. Accordingly, the temperature value and the humidity value in the detected temperature/humidity combination are compared with the corresponding values in the high temperature-and-high humidity environmental value combination H/H. When at least one of the detected temperature/humidity values is greater than the corresponding value in the high temperature-and-high humidity environmental value combination H/H, the judgment of S51 becomes affirmative. However, when both of the detected temperature/humidity values are equal to or smaller than the values in the high temperature-and-high humidity environmental value combination H/H, the judgment of S51 becomes negative.

When the environment does not exceed the high temperature-and-high humidity environmental value combination H/H (no in S51), it is further judged in S52 whether or not the environment exceeds the normal temperature-and-normal humidity environmental value combination N/N. When at least one of the detected temperature/humidity values is greater than the corresponding value in the normal temperature-and-normal humidity environmental value combination N/N, the judgment of S52 becomes affirmative. However, when both of the detected temperature/humidity values are equal to or smaller than the values in the normal temperature-and-normal humidity environmental value combination N/N, the judgment of S52 becomes negative. When the environment does not exceed the normal temperature-and-normal humidity environmental value combination N/N (no in S52), the rotational speed of the drum cleaning roller 18 is set to the eighth rotational-speed A8 in S53. That is, the CPU 51 sets the cleaning driving circuit 57 to drive the cleaning motor 56 to rotate the drum cleaning roller 18 at the eighth rotational-speed A5. Thereafter, the post-jam process of S24 is executed with the set speed A8, and when the predetermined cleaning time elapses, the post-jam process is ended in S25.

When the environment exceeds the high temperature-and-high humidity environmental value combination H/H (yes in S51), the rotational speed of the drum cleaning roller 18 is set to the sixth rotational-speed A6 in S54. That is, the CPU 51 sets the cleaning driving circuit 57 to drive the cleaning motor 56 to rotate the drum cleaning roller 18 at the sixth rotational-speed A6. Thereafter, the post-jam process of S24 is executed with the set speed A6, and when the predetermined cleaning time elapses, the post-jam process is ended in S25.

When the environment does not exceed the high temperature-and-high humidity environmental value combination H/H (no in S51) but exceeds the normal temperature-and-normal humidity environmental value combination N/N (yes in S52), the rotational speed of the drum cleaning roller 18 is set to the seventh rotational-speed A7 in S55. That is, the CPU 51 sets the cleaning driving circuit 57 to drive the cleaning motor 56 to rotate the drum cleaning roller 18 at the seventh rotational-speed A7. Thereafter, the post-jam process of S24 is executed with the set speed A7, and when the predetermined cleaning time elapses, the post-jam process is ended in S25.

As the temperature and humidity of the environment where the laser printer 1 is located rises, the printing density attained by the laser printer 1 increases. As the temperature and humidity of the environment lowers, the printing density attained by the laser printer 1 decreases. Accordingly, the amount of toner residing on the photosensitive drum 13, at the time of sheet jam, changes according to the temperature and humidity at that time.

According to the transfer jam control of the present modification, therefore, the rotational speed, at which the drum cleaning roller 18 rotates to execute the post-jam process, is changed dependently on the temperature and humidity. Even when the amount of toner residing on the photosensitive drum 13 changes according to the temperature and humidity, by changing the rotational speed of the drum cleaning roller 18 dependently on the temperature and humidity, it is ensured that the drum cleaning roller 18 can sufficiently collect the residual toner from the photosensitive drum 13.

<Second Embodiment>

A laser printer 1 according to a second embodiment of the present invention will be described below with reference to FIGS. 8–12.

The laser printer 1 of the present embodiment has the same structure as that of the first embodiment shown in FIG. 1.

Also in the laser printer 1 of this embodiment, after a sheet of paper 3 is jammed, the post-jam process is executed to apply the transfer roller 15 with the reverse transfer bias voltage similarly to the first embodiment. The reverse transfer bias voltage has polarity that is opposite to that of the normal transfer bias voltage applied to the transfer roller 15 during the normal transfer process, and therefore that is the same as the polarity of the charged toner. Additionally, according to the present embodiment, during the normal process, the drum cleaning roller 18 is applied with a normal cleaning bias voltage B0 with respect to the photosensitive drum 13. After a sheet jam occurs, the drum cleaning roller 18 is applied with a first cleaning bias voltage B1 with respect to the photosensitive drum 13. It is noted that both of the normal and first cleaning bias voltages B0 and B1 have negative polarity that is opposite to the polarity of the charged toner. The absolute value |B1| of the first cleaning bias voltage B1 is greater than the absolute value |B0| of the normal cleaning bias voltage B0. Accordingly, the potential difference obtained between the drum cleaning roller 18 and the photosensitive drum 13 when the drum cleaning roller 18 is applied with the first cleaning bias voltage 51 becomes greater than the potential difference obtained between the drum cleaning roller 18 and the photosensitive drum 13 when the drum cleaning roller 18 is applied with the normal cleaning bias voltage B0.

Figure 8:
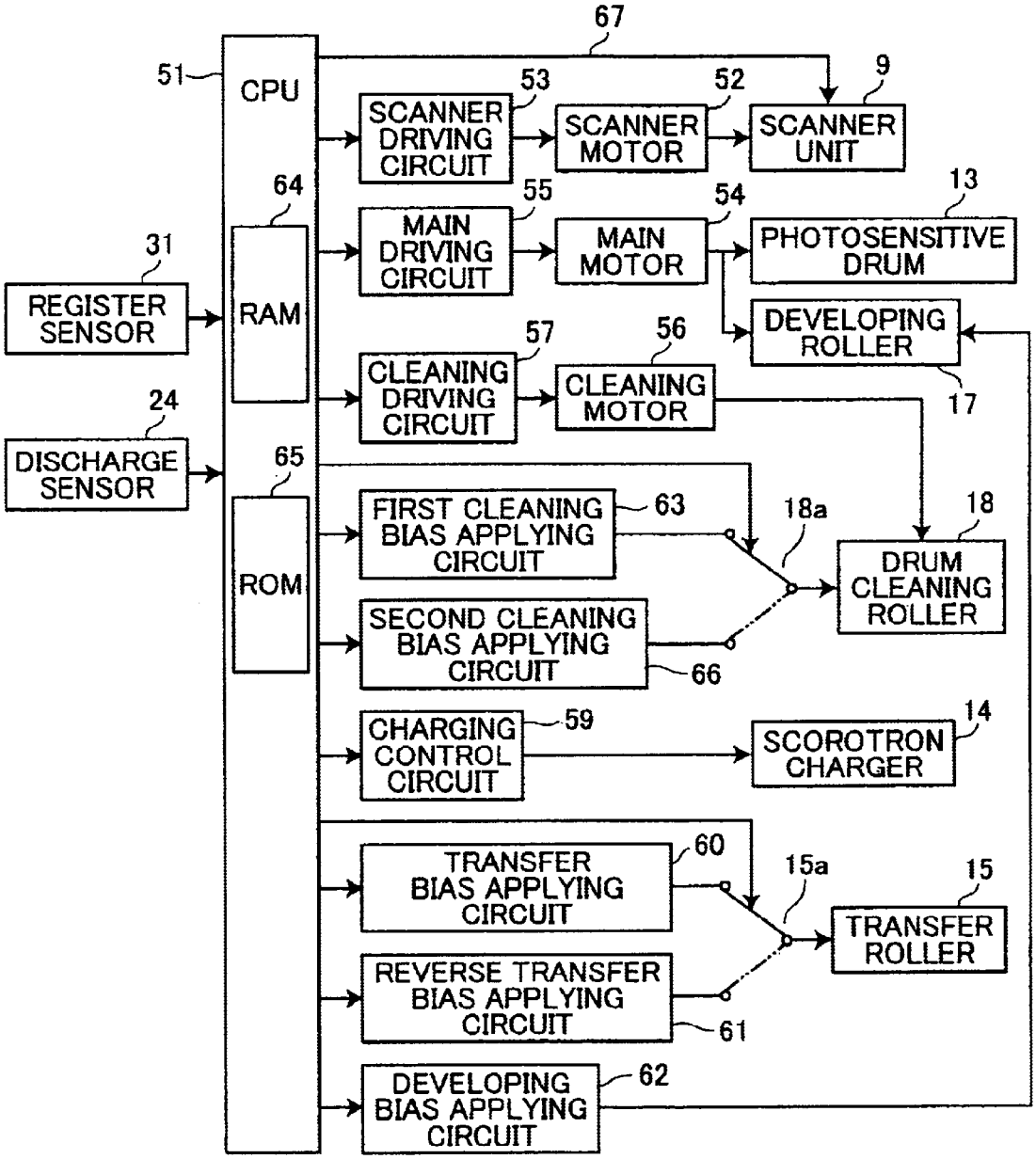
FIG. 8 is a block diagram of a control system for a processing portion in the laser printer of FIG. 1 according to a second embodiment.

FIG. 8 is a block diagram showing a control system for the processing portion 10 in the laser printer 1. The components the same as those in FIG. 2 are indicated by the same reference numerals, and description of them will be omitted.

As shown in FIG. 8, instead of providing the single cleaning bias applying circuit 58 (FIG. 2), according to the present embodiment, a first cleaning bias applying circuit 63 and a second cleaning bias applying circuit 66 are provided as being connected to the CPU 51. The first cleaning bias applying circuit 63 is for applying the normal cleaning bias voltage B0. The second cleaning bias applying circuit 66 is for applying the first cleaning bias voltage B1.

The first cleaning bias applying circuit 63 and the second cleaning bias applying circuit 66 are connected to the roller shaft of the drum cleaning roller 18 via a cleaning switch 18*a*. The CPU 51 is connected to the cleaning switch 18*a*. The CPU 51 controls the switch 18*a* to selectively connect one of the first and second cleaning bias applying circuits 63 and 66 to the roller shaft of the drum cleaning roller 18.

During the image forming process, according to the main drive control program, the CPU 51 controls the switch 18*a* to connect the first cleaning bias applying circuit 63 to the roller shaft of the drum cleaning roller 18, and controls to turn on and turn off the normal cleaning bias voltage B0 applied to the drum cleaning roller 18 via the first cleaning bias applying circuit 63.

When a sheet of paper 3 is jammed, according to the transfer jam control program, the CPU 51 controls the switch 18*a* to connect the second cleaning bias applying circuit 66 to the roller shaft of the drum cleaning roller 18, and controls to turn on and turn off the first cleaning bias voltage B1 applied to the drum cleaning roller 18 via the second cleaning bias applying circuit 66.

Figure 9:
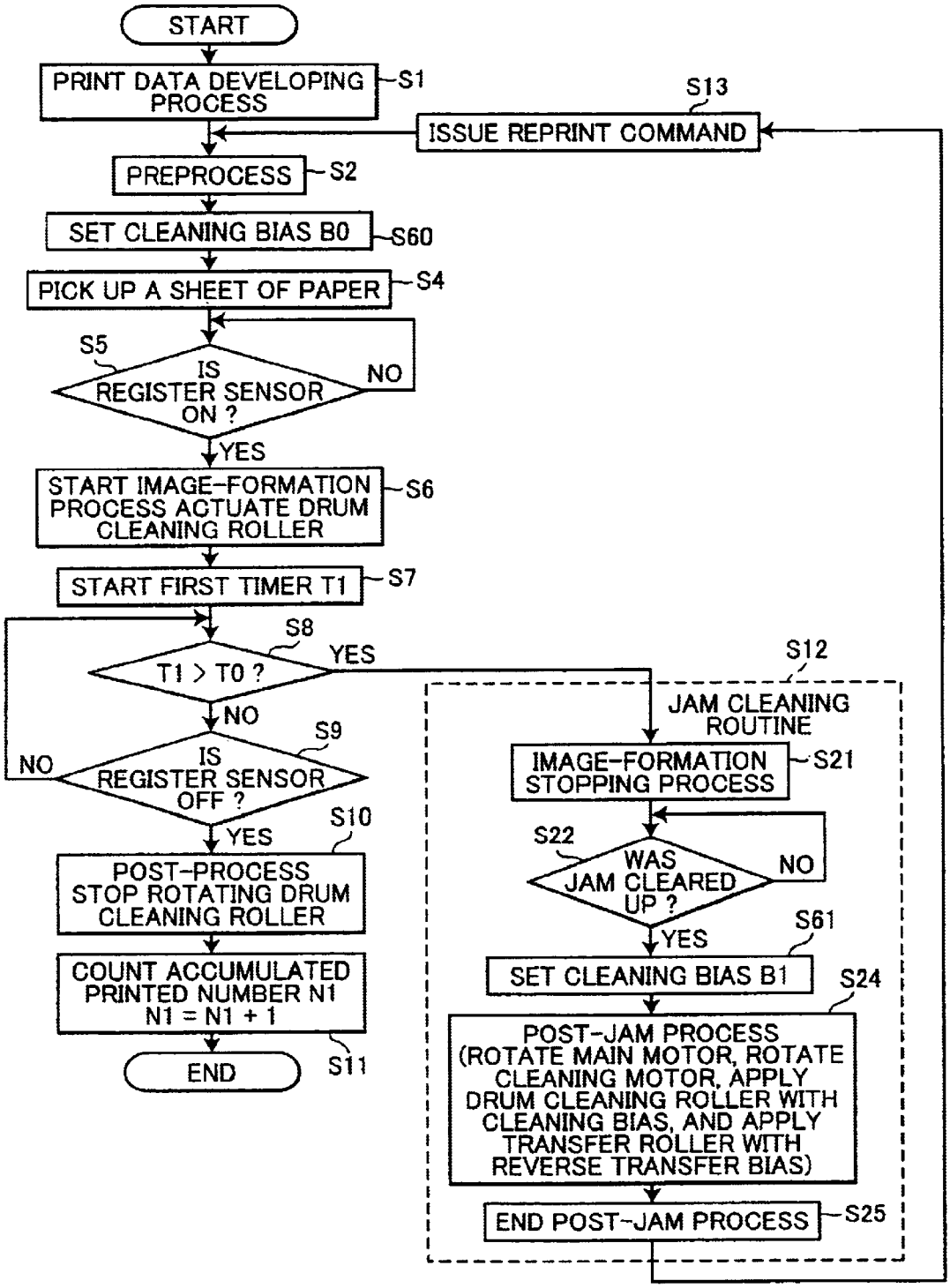
FIG. 9 is a flowchart of a control process according to the second embodiment, wherein during the post-jam process, the drum cleaning roller is applied with a cleaning bias different from a normal cleaning bias.

FIG. 9 shows the processes of the transfer jam control program according to the present embodiment. In FIG. 9, the same processes as those in FIG. 3 are indicated by the same references, and therefore description thereof will be omitted.

As shown in FIG. 9, after the preprocessing of S2 is completed in the same manner as in the first embodiment, the drum cleaning roller 18 is set with the normal cleaning bias voltage B0 in S60. That is, the CPU 51 controls the switch 18*a* to connect the first cleaning bias applying circuit 63 to the drum cleaning roller 18. Accordingly, in S6, the drum cleaning roller 18 is applied with the normal cleaning bias voltage B0 with respect to the photosensitive drum 13. During the jam cleaning routine of S12, after the jam is cleared up (yes in S22), the drum cleaning roller 18 is set with the first cleaning bias voltage B1 in S61. That is, the CPU 51 controls the switch 18*a* to connect the second cleaning bias applying circuit 66 to the drum cleaning roller 18. Thereafter, in S24, the post-jam process is executed to drive the main motor 54 and the cleaning motor 56, to apply the first cleaning bias voltage B1 to the drum cleaning roller 18, and to apply the transfer roller 15 with the reverse transfer bias from the reverse transfer bias applying circuit 61 via the switch 15*a*.

Figure 10:
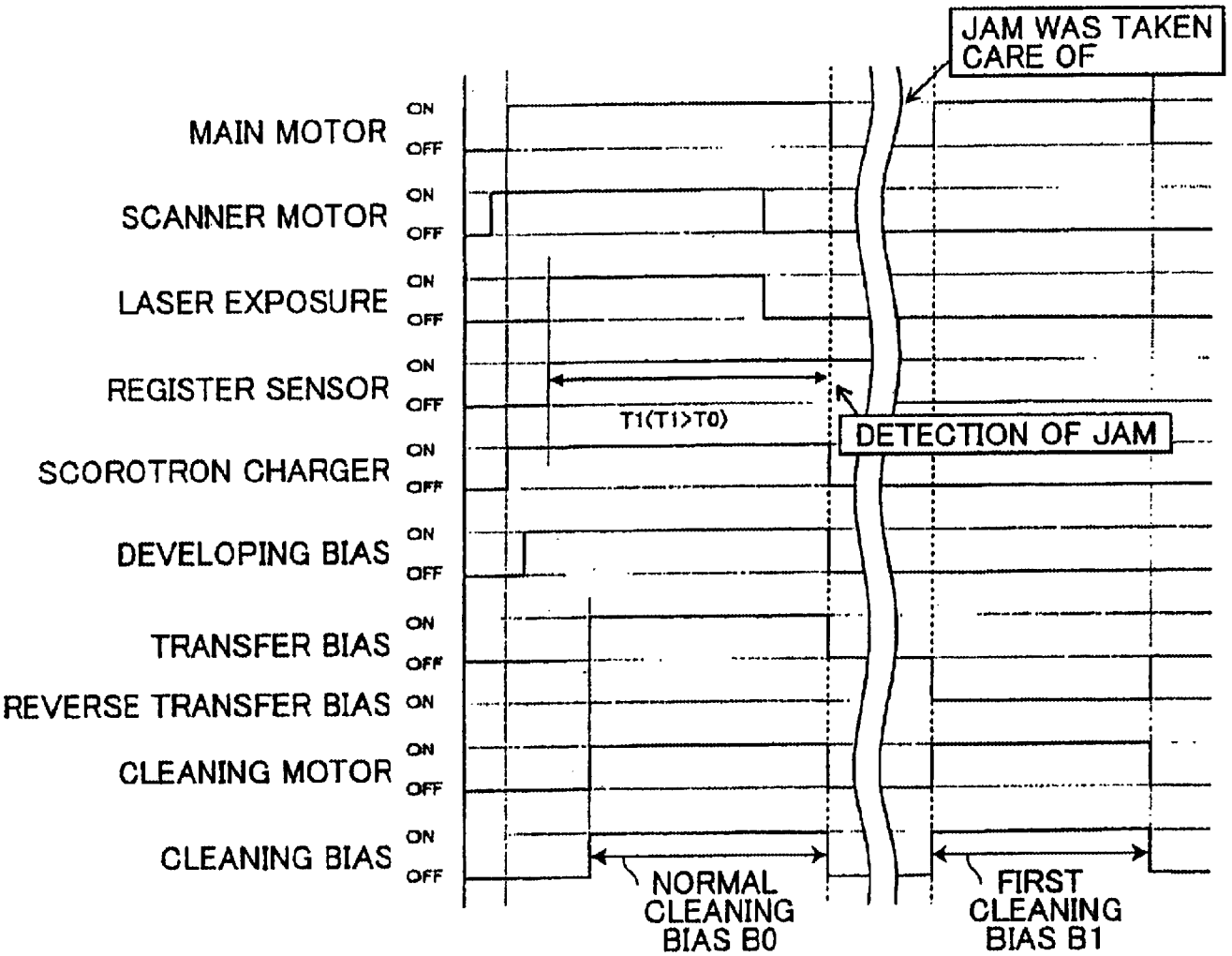
FIG. 10 shows timing charts of respective parts according to the control process of FIG. 9.

FIG. 10 is a timing chart showing how the respective components are driven and the respective bias voltages are applied when a sheet of paper 3 is jammed in the processing portion 10.

As shown in FIG. 10, according to the present embodiment, contrary to the process of FIG. 4, the rotational number of the cleaning motor 56 is not changed, but is maintained the same before and after the jam is cleared up.

In other words, even after the jam is cleared up, the rotational number of the drum cleaning roller 18 is unchanged from the normal rotational speed A0. However, after the jam is cleared up, the cleaning bias applied to the drum cleaning roller 18 is set to the first cleaning bias voltage B1, whose absolute value is greater than that of the normal cleaning bias voltage B0. Except for other components, the same control is executed with that of FIG. 4, and description of them will be omitted.

In this way, when a sheet of paper 3 is jammed, according to the transfer jam control program of the present embodiment, after the jam is cleared up, the bias applied to the drum cleaning roller 18 is increased from the normal cleaning bias voltage B0 into the first cleaning bias voltage B1. As a result, the potential difference between the drum cleaning roller 18 and the photosensitive drum 13 is increased. It is therefore ensured that the drum cleaning roller 18 can properly and sufficiently collect the large amount of residual toner on the photosensitive drum 13. Additionally, according to the transfer jam control program, during the post-jam process of S24, the transfer roller 15 is applied with the reverse transfer bias voltage from the reverse transfer bias applying circuit 61 via the switch 15*a* similarly to the first embodiment. Because the polarity of the reverse bias voltage is the same as that of toner, it is possible to prevent the large amount of toner, which remains due to the jam, from attaching to the transfer roller 15. It is ensured that the large amount of toner remaining due to the jam be collected by the drum cleaning roller 18.

It is noted that the Scorotron charger 14 may be turned ON during the post-jam process of S24 in order to ensure that the drum cleaning roller 18 can collect toner more properly.

(First Modification)

In a first modification of the second embodiment, the transfer jam control program is modified to set a plurality of different cleaning bias voltages for the drum cleaning roller 18. One of the plurality of cleaning bias voltages is selected and set dependently on the accumulated printed number N1.

Figure 11:
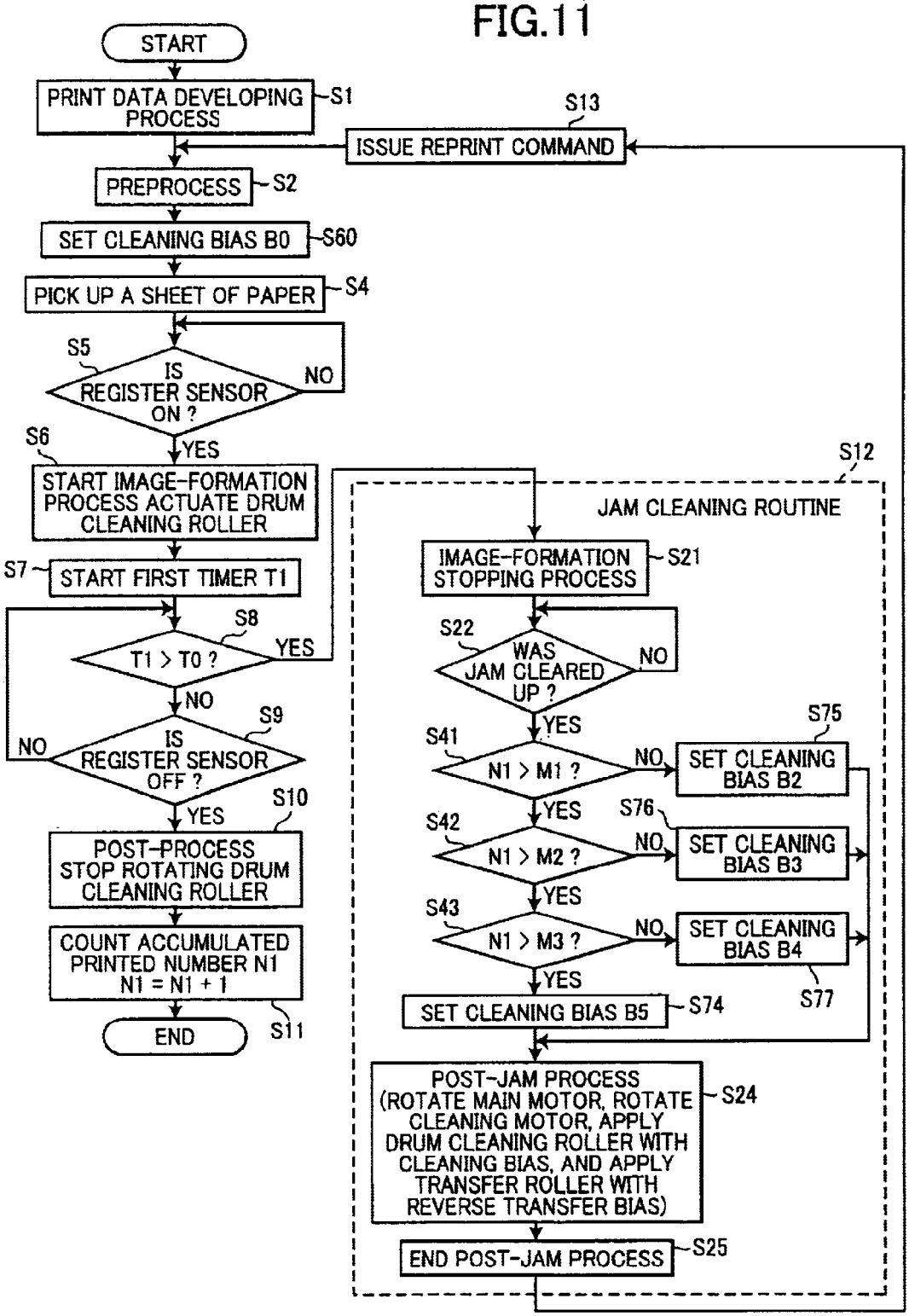
FIG. 11 is a flowchart of a control process according to a first modification of the second embodiment, wherein the cleaning bias of the drum cleaning roller during the post-jam process changes dependently on the accumulated printed number.

FIG. 11 shows the processes of the transfer jam control program according to this modification. In FIG. 11, the same processes as those in FIGS. 6 and 9 are indicated by the same references, and therefore description of them will be omitted.

It is noted that "second cleaning bias voltage B2", "third cleaning bias voltage B3", "fourth cleaning bias voltage B4", and "fifth cleaning bias voltage B5" are previously set as a plurality of bias voltages to be applied to the drum cleaning roller 18. All the second through fifth cleaning bias voltages B2, B3, B4, and B5 have negative polarity opposite to the polarity of the charged toners, and satisfy the following relationship: $|B0|<|B2|<|B3|<|B4|<|B5|$. It is noted that the second cleaning bias applying circuit 66 can apply the second through fifth cleaning bias voltages B2, B3, B4, and B5 to the drum cleaning roller 18.

In this modification, as shown in FIG. 11, after the preprocess of S2 is executed, the normal cleaning bias voltage B0 is set to the drum cleaning roller 18 in S60 in the same manner as in FIG. 9. In the jam cleaning routine of S12, after the jam is cleared up (yes in S22), if the accumulated printed number N1 exceeds the third printed number M3 (yes in S43), the drum cleaning roller 18 is set to the fifth cleaning bias voltage B5 in S74. That is, the CPU 51 controls the switch 18*a* to connect the second cleaning bias applying circuit 66 with the drum cleaning roller 18, and controls the second cleaning bias applying circuit 66 to apply the drum cleaning roller 18 with the fifth cleaning bias voltage B5. If the accumulated printed number N1 does not exceed the first printed number M1 (no in S41), the drum cleaning roller 18 is set to the second cleaning bias voltage B2 in S75. That is, the CPU 51 controls the switch 18*a* to connect the second cleaning bias applying circuit 66 with the drum cleaning roller 18, and controls the second cleaning bias applying circuit 66 to apply the drum cleaning roller 18 with the second cleaning bias voltage B2. If the accumulated printed number N1 exceeds the first printed number M1 (yes in S41) but does not exceed the second printed number M2 (no in S42), the drum cleaning roller 18 is set to the third cleaning bias voltage 83 in S76. That is, the CPU 51 controls the switch 18*a* to connect the second cleaning bias applying circuit 66 with the drum cleaning roller 18, and controls the second cleaning bias applying circuit 66 to apply the drum cleaning roller 18 with the third cleaning bias voltage B3. If the accumulated printed number N1 exceeds the second printed number M2 (yes in S42) but does not exceed the third printed number M3 (no in S43), the drum cleaning roller 18 is set to the fourth cleaning bias voltage B4 in S77. That is, the CPU 51 controls the switch 18*a* to connect the second cleaning bias applying circuit 66 with the drum cleaning roller 18, and controls the second cleaning bias applying circuit 66 to apply the drum cleaning roller 18 with the fourth cleaning bias voltage B4.

In this way, according to the present modification, the cleaning bias applied to the drum cleaning roller 18 during the post-jam process of S24 is changed dependently on the number of printing which the printer 1 has accomplished from the time when the development cartridge 12 has been replaced with a new one until the time when the sheet of paper is jammed. Even when the amount of toner residing on the photosensitive drum 13 increases according to the increase in the number of printing, it is ensured that the is drum cleaning roller 18 can properly collect the residual toner on the photosensitive drum 13.

(Second Modification)

According to the present modification, the cleaning bias applied to the drum cleaning roller 18 is changed dependently on the environment where the laser printer 1 is located.

Figure 12:
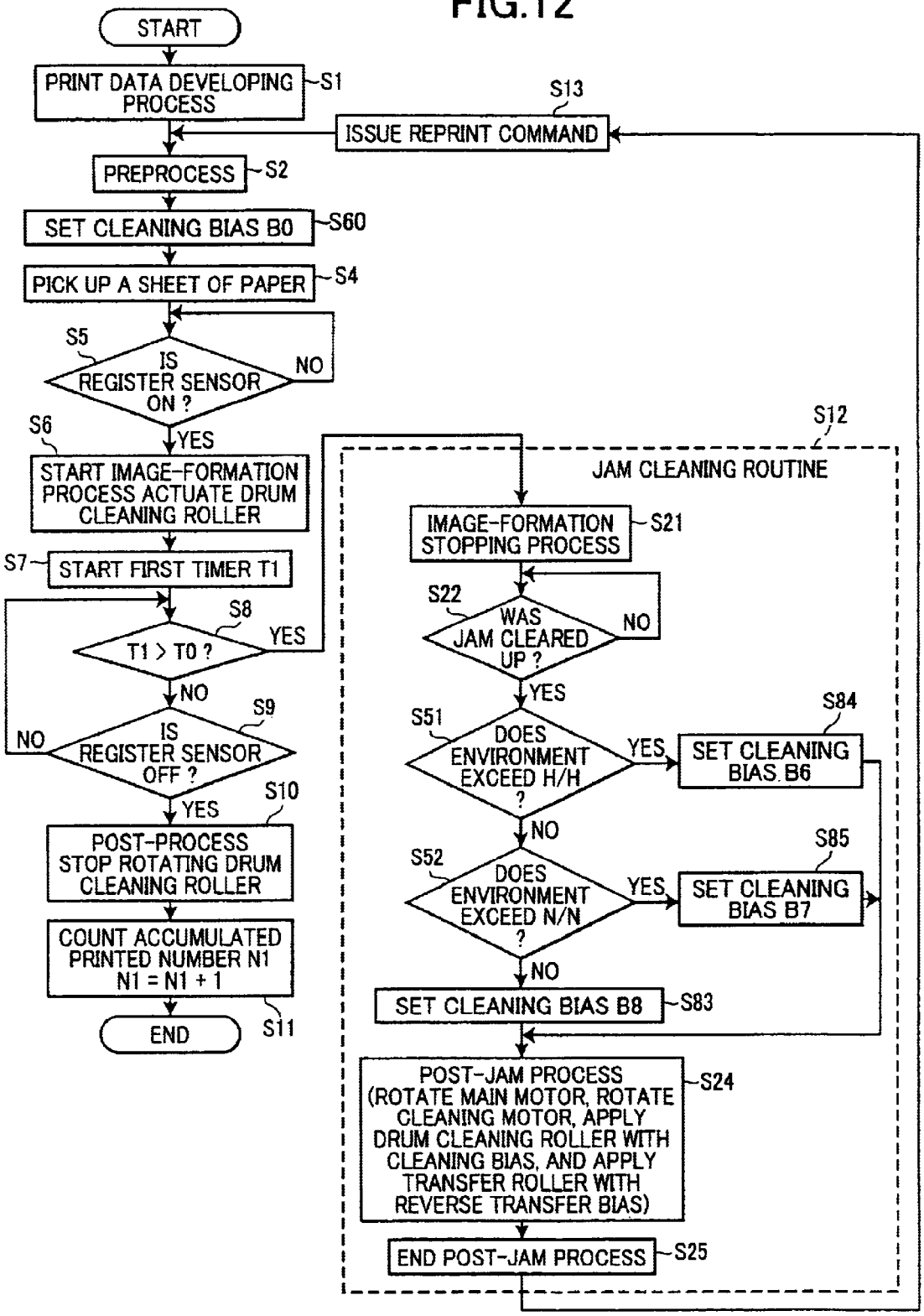
FIG. 12 is a flowchart of a control process according to a second modification of the second embodiment, wherein the cleaning bias of the drum cleaning roller during the post-jam process changes dependently on the environment.

FIG. 12 shows the processes of the transfer jam control program according to this modification. In FIG. 12, the same processes as those in FIGS. 7 and 9 are indicated by the same references, and therefore description of them will be omitted.

It is noted that "sixth cleaning bias voltage B6", "seventh cleaning bias voltage B7", and "eighth cleaning bias voltage B8" are previously set as cleaning bias voltages to be applied to the drum cleaning roller 18. All the sixth through eighth cleaning bias voltages B6, B7, and B8 have negative polarity opposite to the polarity of the charged toners, and satisfy the following relationship: $|B0|<|B8|<|B7|<|B6|$. It is noted that the second cleaning bias applying circuit 66 can apply the sixth through eighth cleaning bias voltages B6, B7, and B8 to the drum cleaning roller 18.

In this process of FIG. 12, after the preprocess of S2, the drum cleaning roller 18 is set to the normal cleaning bias voltage B0 in S60 in the same manner as in FIG. 9. During the jam cleaning routine of S12, after the jam of the sheet of paper 3 is cleared up in S22, if the environment where the laser printer 1 is located does not exceed the normal temperature-and-normal humidity environmental value combination N/N (no in S52), the cleaning bias is set to the eighth cleaning bias voltage B8 in S83. That is, the CPU 51 controls the switch 18*a* to connect the second cleaning bias applying circuit 66 with the drum cleaning roller 18, and controls the second cleaning bias applying circuit 66 to apply the drum cleaning roller 18 with the eighth cleaning bias voltage B8. If the environment exceeds the high temperature-and-high humidity environmental value combination H/H (yes in S51), the cleaning bias is set to the sixth cleaning bias voltage B6 in S84. That is, the CPU 51 controls the switch 18*a* to connect the second cleaning bias applying circuit 66 with the drum cleaning roller 18, and controls the second cleaning bias applying circuit 66 to apply the drum cleaning roller 18 with the sixth cleaning bias voltage B6. If the environment does not exceed the high temperature-and-high humidity environmental value combination H/H (no in S51) but exceeds the normal temperature-and-normal humidity environmental value combination N/N (yes in S52), the cleaning bias is set to the seventh cleaning bias voltage B7 in S85. That is, the CPU 51 controls the switch 15*a* to connect the second cleaning bias applying circuit 66 with the drum cleaning roller 18, and controls the second cleaning bias applying circuit 66 to apply the drum cleaning roller 18 with the seventh cleaning bias voltage B7.

According to the present modification, the cleaning bias applied to the drum cleaning roller 18 during the post-jam process of S24 is changed dependently on the temperature and humidity. Even when the amount of toner residing on the photosensitive drum 13 changes according to the temperature and humidity, by changing the cleaning bias to the drum cleaning roller 18 during the post-jam process dependently on the temperature and humidity, it is ensured that the drum cleaning roller 18 can properly collect the residual toner on the photosensitive drum 13.

<Third Embodiment>

A laser printer 1 according to a third embodiment of the present invention will be described below with reference to FIGS. 13–15.

The laser printer 1 of the present embodiment has the same structure with that of the first embodiment shown in FIGS. 1 and 2.

In the laser printer 1 of this embodiment, after a sheet of paper 3 is jammed, the post-jam process is executed to apply the transfer roller 15 with the reverse transfer bias voltage similarly to the first and second embodiments. Additionally, instead of changing the rotational speed or the cleaning bias of the drum cleaning roller 18, the CPU 51 of the present embodiment changes the rotational speed of the photosensitive drum 13.

Figure 13:
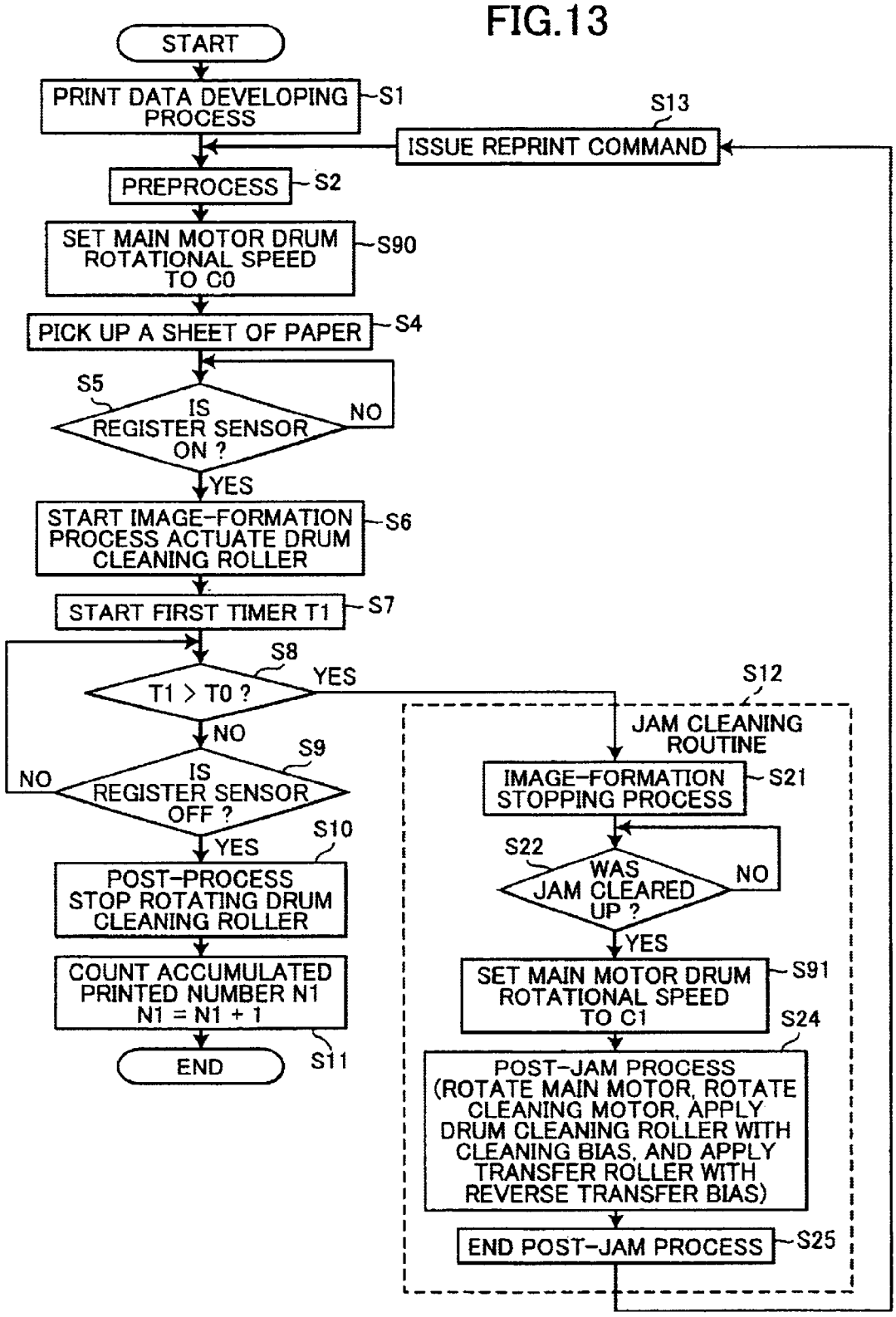
FIG. 13 is a flowchart of a control process according to a third embodiment, wherein during the post-jam process, the photosensitive drum is rotated at a rotational speed different from a normal drum rotational speed.

FIG. 13 shows the processes of the transfer jam control program according to the present embodiment. In FIG. 13, the same processes as those in FIG. 3 are indicated by the same references, and therefore description of them will be omitted.

It is noted that "normal drum rotational-speed C0" is defined as a rotational speed, at which the photosensitive drum 13 should be rotated during the normal printing process, that is, while a sheet of paper 3 is not jammed. A "first drum rotational-speed C1" is a rotational speed at which the photosensitive drum 13 should be rotated during the post-jam process. The first drum rotational-speed C1 is lower than the normal drum rotational-speed C0. It is noted that the first drum rotational-speed C1 is previously determined freely depending on the configuration of the laser printer 1 and on the printing condition so that the first drum rotational-speed C1 will be lower than the normal drum rotational-speed C0.

In the process of FIG. 13, after the preprocess of S2, the rotational speed of the main motor 54 is set to the normal drum rotational-speed C0 in S90. That is, the CPU 51 sets the main driving circuit 55 to drive the main motor S4 to rotate the photosensitive drum 13 at the normal drum rotational-speed C0. Accordingly, during the image forming process of S6, the main motor 54 is controlled to rotate the photosensitive drum 13 at the normal drum rotational-speed C0. In the jam cleaning routine of S12, after the jam is cleared up (yes in S22), the rotational speed of the main motor 54 is set to the first drum rotational-speed C1 in S91. That is, the CPU 51 sets the main driving circuit 55 to drive the main motor 54 to rotate the photosensitive drum 13 at the first drum rotational-speed C1. Accordingly, during the post-jam process of S24, the main motor 54 is controlled to rotate the photosensitive drum 13 at the first drum rotational-speed C1.

In this way, when a sheet of paper 3 is jammed, after the jam is cleared up, the photosensitive drum 13 is rotated, during the post-jam process, at the rotational speed C1 that is lower than the rotational speed C0 in the normal actuating condition. Accordingly, the relative speed of the drum cleaning roller 18 with respect to the photosensitive drum 13 during the post-jam process is greater than that in the normal image forming process. Even when a large amount of toner remains on the photosensitive drum 13, the drum cleaning roller 18 can sufficiently collect the toner. Additionally, according to the transfer jam control program, during the post-jam process of S24, the transfer roller 15 is applied with the reverse transfer bias voltage from the reverse transfer bias applying circuit 61 via the switch 15*a* similarly to the first and second embodiments. Because the polarity of the reverse bias voltage is the same as that of toner, it is possible to prevent the large amount of toner, which remains due to the jam, from attaching to the transfer roller 15. It is ensured that the large amount of toner remaining due to the jam be collected by the drum cleaning roller 18.

It is noted that the Scorotron charger 14 may be turned ON during the post-jam process of S24 in order to ensure that the drum cleaning roller 18 can collect toner more properly.

(First Modification)

According to the present modification, a plurality of different rotational speeds are prepared for the photosensitive drum 13 and one rotational speed is selected and set dependently on the accumulated printed number N1.

Figure 14:
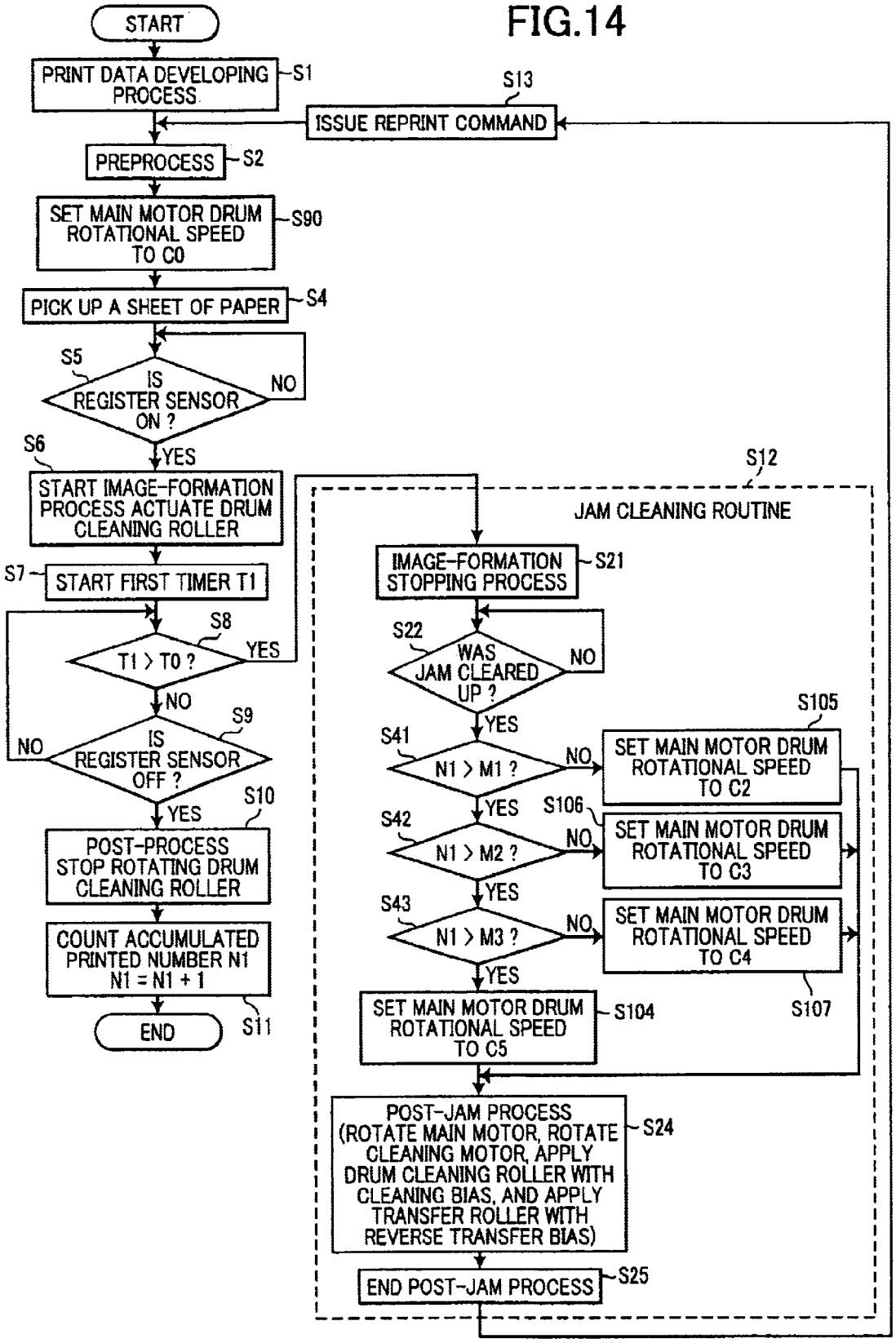
FIG. 14 is a flowchart of a control process according to a first modification of the third embodiment, wherein the rotational speed of the photosensitive drum changes dependently on the accumulated printed number.

FIG. 14 shows the processes according to this modification. In FIG. 14, the same processes as those in FIGS. 6 and 13 are indicated by the same references, and therefore description of them will be omitted.

It is noted that "second drum rotational-speed C2", "third drum rotational-speed C3", "fourth drum rotational-speed C4", and "fifth drum rotational-speed C5" are previously set as rotational speeds of the photosensitive drum 13, and satisfy the following relationship: C0>C2>C3>C4>C5.

In this modification, as shown in FIG. 14, after the preprocess of S2 is executed, the main motor 54 is set with the normal drum rotational-speed C0 in S90 in the same manner as in FIG. 13. In the jam cleaning routine of S12, after the jam is cleared up (yes in S22), if the accumulated printed number N1 exceeds the third printed number M3 (yes in S43), the rotational speed of the main motor 54 is set to the fifth drum rotational-speed C5 in S104. That is, the CPU 51 sets the main driving circuit 55 to drive the main motor 54 to rotate the photosensitive drum 13 at the fifth drum rotational-speed C5. If the accumulated printed number N1 does not exceed the first printed number M1 (no in S41), the rotational speed of the main motor 54 is set to the second drum rotational-speed C2 in S105. That is, the CPU 51 sets the main driving circuit 55 to drive the main motor 54 to rotate the photosensitive drum 13 at the second drum rotational-speed C2. If the accumulated printed number N1 exceeds the first printed number M1 (yes in S41) but does not exceed the second printed number M2 (no in S42), the rotational speed of the main motor 54 is set to the third drum rotational-speed C3 in S106. That is, the CPU 51 sets the main driving circuit 55 to drive the main motor 54 to rotate the photosensitive drum 13 at the third drum rotational-speed C3. If the accumulated printed number N1 exceeds the second printed number M2 (yes in S42) but does not exceed the third printed number M3 (no in S43), the rotational speed of the main motor 54 is set to the fourth drum rotational-speed C4 in S107. That is, the CPU 51 sets the main driving circuit 55 to drive the main motor 54 to rotate the photosensitive drum 13 at the fourth drum rotational-speed C4.

In this way, the rotational speed at which the photosensitive drum 13 is rotated during the post-jam process of S24 is changed dependently on the number of printing the printer 1 has accomplished. Even when the amount of toner residing on the photosensitive drum 13 increases according to the increase in the number of printing, it is ensured that the drum cleaning roller 18 can sufficiently collect the residual toner on the photosensitive drum 13.

(Second Modification)

According to this modification, the rotational speed of the photosensitive drum 13 is changed dependently on the environment where the laser printer 1 is located.

Figure 15:
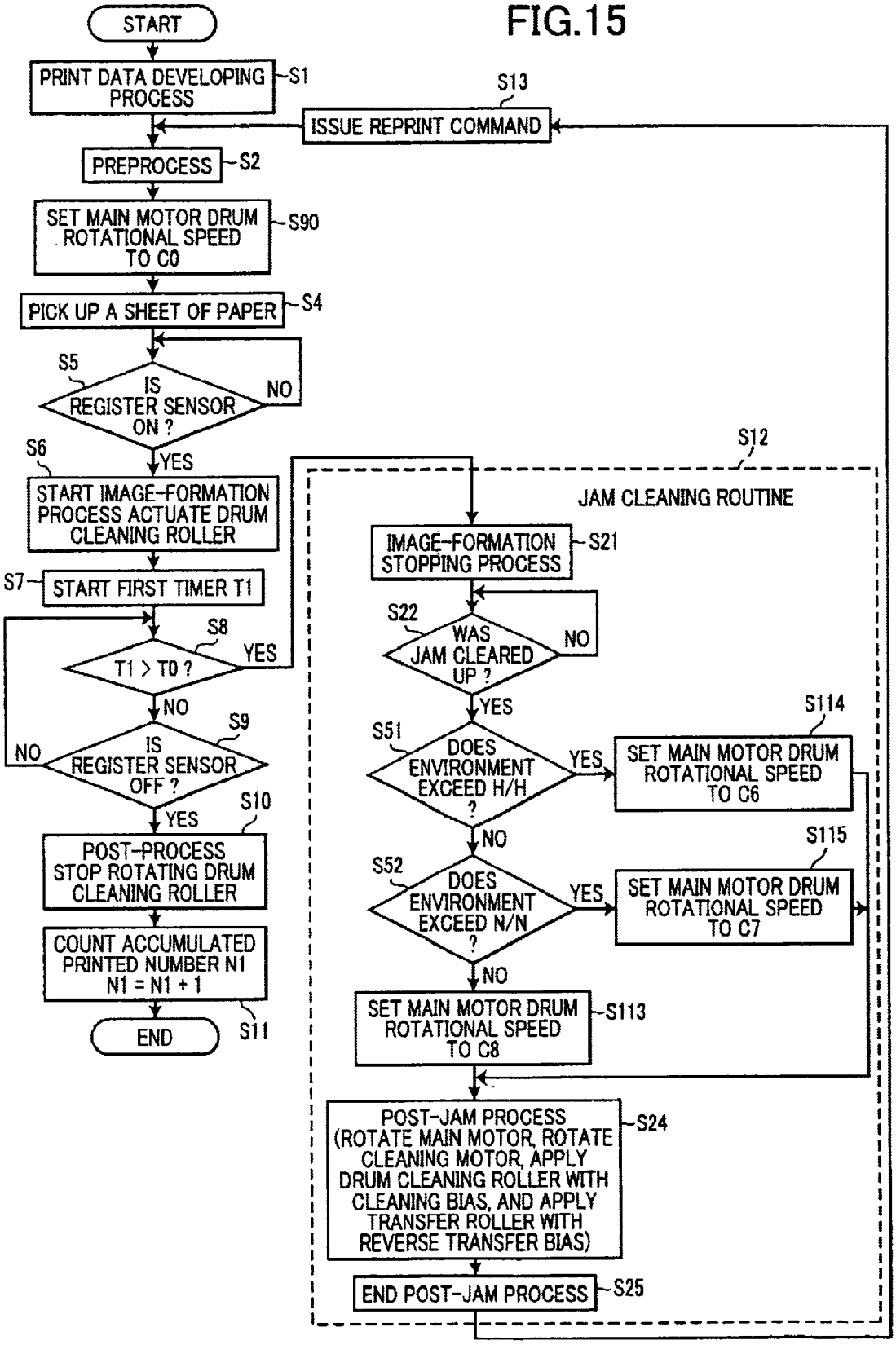
FIG. 15 is a flowchart of a control process according to a second modification of the third embodiment, wherein the rotational speed of the photosensitive drum changes dependently on the environment.

FIG. 15 shows the processes according to this modification. In FIG. 15, the same processes as those in FIGS. 7 and 13 are indicated by the same references, and therefore description of them will be omitted.

It is noted that "sixth drum rotational-speed C6", "seventh drum rotational-speed C7", and "eighth drum rotational-speed C8" are previously determined as rotational speeds of the photosensitive drum 13 and satisfy the following relationship: C0>C8>C7>C6.

In this process of FIG. 15, after the preprocess of S2, the rotational speed of the main motor 54 is set to the normal drum rotational-speed C0 in S90 in the same manner as in FIG. 13. During the jam cleaning routine of S12, after the jam is cleared up in S22, when the environment where the laser printer 1 is located does not exceed the normal temperature-and-normal humidity environmental value combination N/N (no in S52), the rotational speed of the main motor 54 is set to the eighth drum rotational-speed C8 in S113. That is, the CPU 51 sets the main driving circuit 55 to drive the main motor 54 to rotate the photosensitive drum 13 at the eighth drum rotational-speed C8. When the environment exceeds the high temperature-and-high humidity environmental value combination H/H (yes in S51), the rotational speed of the main motor 54 is set to the sixth drum rotational-speed C6 in S114. That is, the CPU 51 sets the main driving circuit 55 to drive the main motor 54 to rotate the photosensitive drum 13 at the sixth drum rotational-speed C6. Then the environment does not exceed the high temperature-and-high humidity environmental value combination H/H (no in S51) but exceeds the normal temperature-and-normal humidity environmental value combination N/N (yes in S52), the rotational speed of the main motor 54 is set to the seventh drum rotational-speed C7 in S115. That is, the CPU 51 sets the main driving circuit 55 to drive the main motor 54 to rotate the photosensitive drum 13 at the seventh drum rotational-speed C7.

In this way, the rotational speed of the photosensitive drum 13 during the post-jam process of S24 is changed dependently on the environment, that is, the temperature and humidity. Even when the amount of toner residing on the photosensitive drum 13 changes dependently on the temperature and humidity, by changing the rotational speed of the photosensitive drum 13 dependently on the temperature and humidity, it is ensured that the drum cleaning roller 18 can always properly collect the residual toner on the photosensitive drum 13.

<Fourth Embodiment>

A laser printer 1 according to a fourth embodiment of the present invention will be described below with reference to FIG. 16.

The laser printer 1 of the present embodiment has the same structure as that of the second embodiment shown in FIGS. 1 and 8.

In the laser printer 1 of this embodiment, after a sheet of paper 3 is jammed, the post-jam process is executed to apply the transfer roller 15 with the reverse transfer bias voltage similarly to the first, second, and third embodiments.

An additional control is executed, during the post-jam process, to drive the drum cleaning roller 18 with the first rotational-speed A1 that is higher than the normal rotational-speed A0 and to apply the drum cleaning roller 18 with the first cleaning bias voltage B1, whose absolute value is higher than that of the normal cleaning bias voltage B0.

Figure 16:
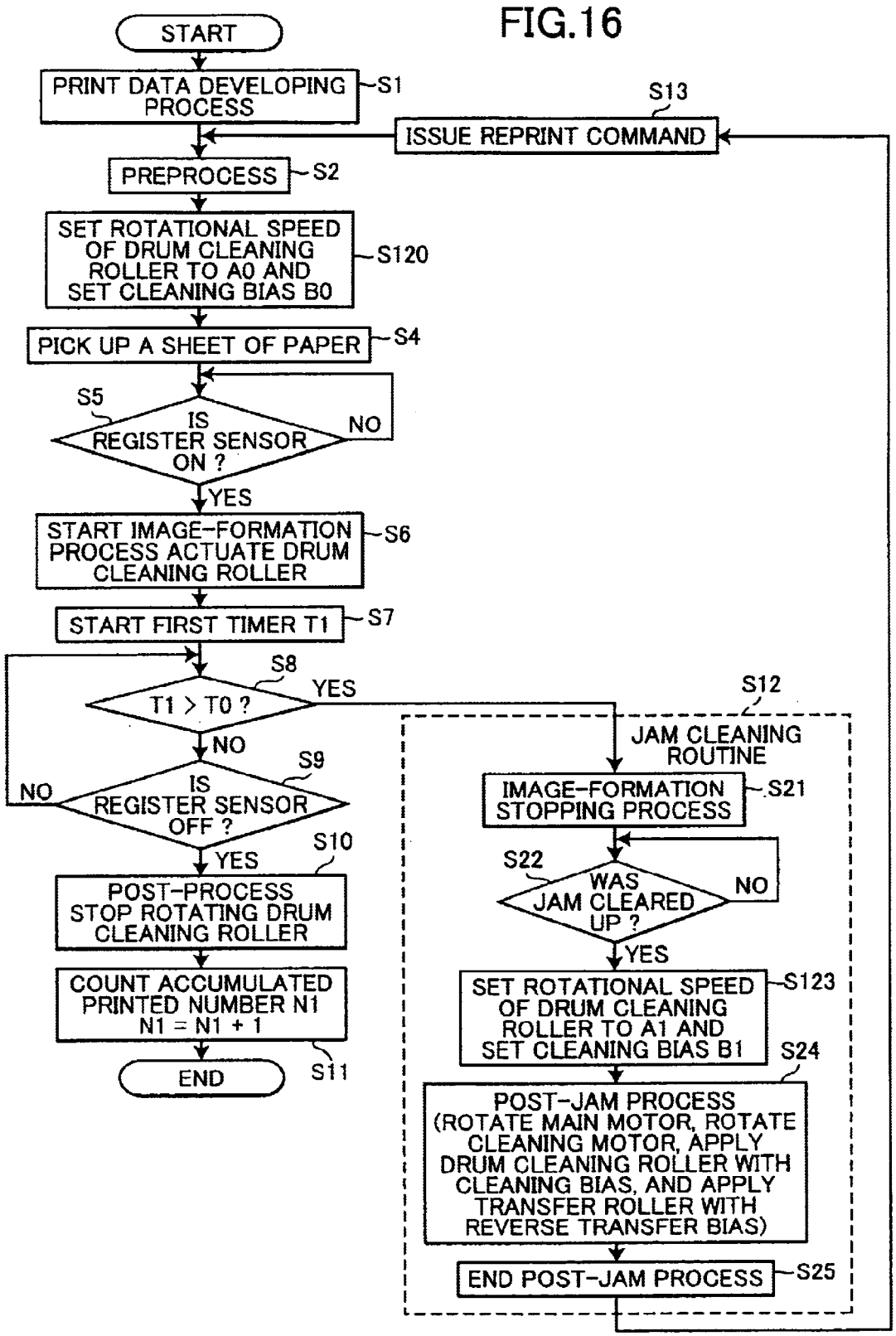
FIG. 16 is a flowchart of a control process according to a fourth embodiment, wherein during the post-jam process, the drum cleaning roller is rotated at a rotational speed different from the normal rotational speed and applied with a cleaning bias different from the normal cleaning bias.

FIG. 16 shows the processes according to this embodiment. In FIG. 16, the same processes as those in FIGS. 3 and 9 are indicated by the same references, and therefore description of them will be omitted.

During the process of FIG. 16, after the preprocessing of S2, the program proceeds to in S120. In S120, the drum cleaning roller 18 is set to the normal rotational-speed A0 in the same manner as in the process of S3 in FIG. 3. The drum cleaning roller 18 is set with the normal cleaning bias voltage B0 in the same manner as in the process of S60 in FIG. 9. During the jam cleaning routine of S12, after the jam is cleared up (yes in S22), the program proceeds to 123. In S123, the rotational speed of the drum cleaning roller 18 set to the first rotational-speed A1 in the same manner as in the process of S23 in FIG. 3. The cleaning bias is set to the first cleaning bias voltage B1 in the same manner as in the process of S61 in FIG. 9. Accordingly, in S24, the post-jam process is executed to drive the main motor 54, to drive the cleaning motor 56 with the first rotational-speed A1, to apply the drum cleaning roller 18 with the first cleaning bias voltage 51, and to apply the transfer roller 15 with the reverse transfer bias voltage from the reverse transfer bias applying circuit 61 via the switch 15*a*.

In this way, the drum cleaning roller 18 is driven in a normal actuating condition (that is, normal rotational-speed A0 and the normal cleaning bias voltage B0) during the normal image forming process. The drum cleaning roller 16 will not be actuated in the condition (that is, first rotational-speed A1 and the first cleaning bias voltage B1) that is set in correspondence with the post-jam process. It is possible to prevent the drum cleaning roller is from excessively sliding against the photosensitive drum 13. It is possible to effectively prevent lowering of the image quality and shortening of the life of the photosensitive drum 13 that will possibly occur due to the excessive sliding.

On the other hand, when a sheet of paper 3 is jammed, after the jam is cleared up, the post-jam process is executed to rotate the drum cleaning roller 18 at the first rotational-speed A1 that is higher than the normal rotational-speed A0, and to apply the drum cleaning roller 18 with the first cleaning bias B1 whose absolute value is greater than that of the normal cleaning bias B0. Even when a large amount of toner remains on the photosensitive drum 13, the drum cleaning roller 18 can properly collect the toner.

It is noted that the Scorotron charger 14 may be turned ON during the post-jam process of S24 in order to ensure that the drum cleaning roller 18 can collect toner more properly.

The control of the present embodiment may be modified in the same manner as in the first and second embodiments. For example, a plurality of different rotational speeds and a plurality of different cleaning bias voltages may be previously set for the drum cleaning roller 18. When a sheet of paper 3 is jammed, the rotational speed and the cleaning bias of the drum cleaning roller 18 during the post-jam process is determined dependently on at least one of the accumulated printed number N1 and the environment where the laser printer 1 is located.

While the invention has been described in detail with reference to the specific embodiments thereof, it would be apparent to those skilled in the art that various changes and modifications may be made therein without departing from the spirit of the invention.

In the fourth embodiment, the control of the first embodiment is combined with the control of the second embodiment. Similarly, the control of the third embodiment may be combined with the control of the first embodiment and/or the second embodiment. In other words, it may be possible to combine the control of the rotational speed of the photosensitive drum 13 with the control of the rotational speed and/or the cleaning bias of the drum cleaning roller 18.

For example, in the process of FIG. 16, the process of S120 may be modified to set not only the rotational speed A0 and the cleaning bias 30 for the drum cleaning roller 18 but also to set the rotational speed C0 for the photosensitive drum 13 in the same manner as in S90 in FIG. 13. The process of S123 may be modified to set not only the rotational speed A1 and the cleaning bias B1 for the drum cleaning roller 18 but also to set the rotational speed C1 for the photosensitive drum 13 in the same manner as in S91 in FIG. 13.

The processes of S31, S32, and S33 in FIG. 5 may be added to the processes of the second through fourth embodiments.

In the above-described embodiments, the sleeve of the photosensitive drum 13 is electrically grounded. However, the sleeve of the photosensitive drum 13 may be applied with some bias voltage.

In the above-described embodiments, toner is charged positively. Accordingly, the cleaning bias voltages B0, B1, _, and B8 have negative polarity that is opposite to the polarity of the charged toner, and the cleaning bias voltages B0, B1, _, and B8 have the relationship that $|B0|<|B1|$, $|B0|<|B2|<|B3|<|B4|<|bB5|$, and $|B0|<|B8|<|B7|<|B6|$. However, if toner is charged negatively, it is preferable that the cleaning bias voltages B0, B1, _, and B8 should have positive polarity opposite to the polarity of the charged toner. In this case, the cleaning bias voltages B0, B1, _, and B8 should have the relationship that $B0<B1$, $B0<B2<B3<B4<B5$, and $B0<B8<B7<B6$.

To summarize, in order to sufficiently collect toner during the post-jam process, the values of the cleaning bias voltages B0, B1, _, and B8 should be prepared to attain the following relationship: $P0<P1$, $P0<P2<P3<P4<P5$, and $P0<P8<P7<P6$, wherein P0, P1, P2, P3, P4, P5, P6, P7, and P8 are potential differences established between the photosensitive drum 13 and the drum cleaning roller 18 when the drum cleaning roller 18 is applied with the cleaning bias voltages B0, B1, B2, B3, B4, B5, 86, B7, and B8, respectively.

In the above-described embodiments, in S51 and S52 (FIGS. 7 and 12), if at least one of the detected temperature value and the detected humidity value exceeds the corresponding value in the reference value combination (H/H, N/N), the judgment becomes affirmative. However, the process of S51 and S52 may be modified so that the judgment becomes affirmative only when both of the detected temperature and humidity values exceed the values in the reference value combination (H/H, N/N).

The second and third modifications of the first embodiment (FIGS. 6 and 7) may be combined together so that one rotational speed is selected dependently on the combination of the printed number N1 and the environment. Similarly, the first and second modifications of the second embodiment (FIGS. 11 and 12) may be combined together so that one cleaning bias voltage is selected dependently on the combination of the printed number N1 and the environment. Similarly, the first and second modifications of the third embodiment (FIGS. 14 and 15) may be combined together so that one main motor speed is selected dependently on the combination of the printed number N1 and the environment.

In the above-described embodiments, the environment is indicated by the combination of the temperature and the humidity. However, the environment may be indicated by only one of the temperature and the humidity.

In the above-described embodiments, when a sheet of paper 3 is jammed, the jam cleaning routine S12 is executed. However, the jam cleaning routine S12 may be executed when other troubles occur against the conveyance of the sheet of paper 3. In this case, in S22, the CPU 51 should judge whether the trouble has been cleared up.

In the above-described embodiments, the laser printer 1 employs the photosensitive drum 13 as an image bearing body. However, the image bearing body of the present invention is not limited to the photosensitive drum 13, but may be configured from a photosensitive belt or the like.

In the above-described embodiments, the laser printer 1 employs the transfer roller 15 as a transfer unit. However, the transfer unit of the present invention is not limited to the transfer roller 15, but may be configured from an intermediate transfer body or the like.

In the above-described embodiments, during the post-jam process of S24, the cleaning-bias voltage and/or the rotational speed of the drum cleaning roller 18 and/or the rotational speed of the photosensitive drum 13 is controlled in a condition different from during the normal image-forming process of S6. However, it may be possible to control, during the post-jam process, other factors of at least one of the drum cleaning roller 18 and the photosensitive drum 13 in a condition different from during the normal image-forming process of S6.

In the above-described embodiments, during the post-jam process of S24, at least one of the drum cleaning roller 18 and the photosensitive drum 13 is controlled in a condition different from during the normal image-forming process of S6. However, it may be possible to control, during the post-jam process, the drum cleaning roller 18 and the photosensitive drum 13 in the same condition as during the normal image-forming process. It is still possible to properly collect toner during the post-jam process by applying the transfer roller 15 with the reverse transfer bias voltage from the reverse transfer bias applying circuit 61.

In the above-described embodiments, during the post-jam process of S24, the transfer roller 15 is applied with the reverse transfer bias voltage from the reverse transfer bias applying circuit 61. However, it is unnecessary to apply the transfer roller 15 with the reverse transfer bias voltage during the post-jam process. The transfer roller 15 may be applied with no bias voltage during the post-jam process. It is still possible to properly collect toner during the post-jam process by controlling at least one of the drum cleaning roller 18 and the photosensitive drum 13 in a condition different from during the normal image-forming process.

What is claimed is:

1. An image forming apparatus, comprising:

a conveying unit conveying a recording medium;

a trouble-detecting unit detecting whether some trouble occurs against conveyance of the recording medium;

a trouble-clearing-up judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body; and a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-up of the trouble, wherein the control unit controls at least one of the cleaning roller and the image bearing body in a first condition when the trouble-detecting unit detects no trouble, the control unit controlling, when the trouble-judging unit detects some trouble, the at least one of the cleaning roller and the image bearing body in a second condition that is different from the first condition after the trouble-clearing-up judging unit judges clearing-un of the trouble, and the control unit changes the second condition in accordance with an image-forming number indicative of the number of images which the image bearing body has produced until the trouble-detecting unit detects the trouble.

2. An image forming apparatus, comprising:

a conveying unit conveying a recording medium;

a trouble-detecting unit detecting whether some trouble occurs against conveyance of the recording medium;

a trouble-clearing-up judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body; and a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-up of the trouble, wherein the control unit controls at least one of the cleaning roller and the image bearing body in a first condition when the trouble-detecting unit detects no trouble, the control unit controlling, when the trouble-judging unit detects some trouble, the at least one of the cleaning roller and the image bearing body in a second condition that is different from the first condition after the trouble-clearing-up judging unit judges clearing-up of the trouble, and the control unit changes the second condition dependently on temperature and humidity in an environment where the image forming apparatus is located.

3. An image forming apparatus, comprising:

a conveying unit conveying a recording medium;

a trouble-detecting unit detecting whether some trouble occurs against conveyance of the recording medium;

a trouble-clearing-up judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body; and a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-up of the trouble; and a charging unit electrically charging the image bearing body, wherein the control unit includes a charging control unit controlling the charging unit to electrically charge the image bearing body if the trouble-clearing-up judging unit judges that it has taken a predetermined period of time or longer to clear up the trouble.

4. An image forming apparatus, comprising:

a conveying unit conveying a recording medium;

a trouble-detecting unit detecting whether some trouble occurs against conveyance of the recording medium;

a trouble-clearing-up judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body;

a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-un of the trouble;

a voltage applying unit applying a cleaning-bias voltage to the cleaning roller with respect to the image bearing body; and a driving unit rotating the cleaning roller at a cleaning-roller-rotational speed, wherein the control unit includes:

a setting unit that sets at least one of the cleaning-bias voltage and the cleaning-roller-rotational speed to a predetermined normal value while the trouble-detecting unit detects no trouble; and a changing unit that changes, after the trouble-clearing-un judging unit judges that the trouble is cleared up, at least one of the cleaning-bias voltage and the cleaning-roller-rotational speed into a changed value that is different from the predetermined normal value, wherein the setting unit sets at least one of an absolute value of the cleaning-bias voltage and the cleaning-roller-rotational speed to the predetermined normal value, the changing unit changing the at least one of the absolute value of the cleaning-bias voltage and the cleaning-roller-rotational speed into the changed value that is greater than the predetermined normal value.

5. An image forming apparatus, comprising:

a conveying unit conveying a recording medium;

a trouble-detecting unit detecting whether some trouble occurs against conveyance of the recording medium;

a trouble-clearing-up judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body;

a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-up of the trouble; and a voltage applying unit applying a cleaning-bias voltage to the cleaning roller with respect to the image bearing body, wherein the control unit includes:

a voltage setting unit that sets the cleaning-bias voltage to a predetermined normal voltage value while the trouble-detecting unit detects no trouble, thereby allowing a potential difference between the cleaning roller and the image bearing body to be a normal potential value; and a voltage changing unit that changes, alter the trouble-clearing-up judging unit judges that the trouble is cleared up, the cleaning-bias voltage from the normal voltage value into a changed voltage value different from the normal voltage value, thereby allowing the potential difference between the cleaning roller and the image bearing body to become a changed potential value that is greater than the normal potential value.

6. An image forming apparatus, comprising:

a conveying unit conveying a recording medium;

a trouble-detecting unit detecting whether some trouble occurs against conveyance of the recording medium;

a trouble-clearing-up judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body;

a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-up of the trouble; and a driving unit rotating the cleaning roller at a cleaning-roller-rotational speed, and wherein the control unit includes:

a speed setting unit that sets the cleaning-roller-rotational speed to a predetermined normal speed value while the trouble-detecting unit detects no trouble, thereby allowing the cleaning roller to rotate at the cleaning-roller-rotational speed of the normal speed value; and a speed changing unit that changes, after the trouble-clearing-up judging unit judges that the trouble is cleared up, the cleaning-roller-rotational speed into a changed speed value that is greater than the normal speed value, thereby allowing the cleaning roller to rotate at the cleaning-miter-rotational speed of the changed speed value.

7. An image forming apparatus, as claimed in claim 6, further comprising a voltage applying unit applying a cleaning-bias voltage to the cleaning roller with respect to the image bearing body, wherein the control unit further includes:

a voltage setting unit that sets the cleaning-bias voltage to a predetermined normal voltage value while the trouble-detecting unit detects no trouble, thereby allowing a potential difference between the cleaning roller and the image bearing body to be a normal potential value; and a voltage changing unit that changes, alter the trouble-clearing-up judging unit judges that the trouble is cleared up, the cleaning-bias voltage into a changed voltage value that is different from the normal voltage value, thereby allowing the potential difference between the cleaning roller and the image bearing body to become a changed potential value that is greater than the normal potential value.

8. An image forming apparatus, comprising:

a conveying unit conveying a recording medium, a trouble-detecting unit detecting whether some trouble occurs against conveyance of the recording medium;

a trouble-clearing-up including unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body;

a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges cleaning-up of the trouble; and an image-bearing-body driving unit rotating the image bearing body at a image-bearing-body-rotational speed, wherein the control unit includes:

a body-speed setting unit that sets the image-bearing-body-rotational speed to a predetermined normal speed value while the trouble-detecting unit detects no trouble, thereby allowing the image bearing body to rotate at the image-bearing-body-rotational speed of the normal speed value; and a body-speed changing unit that changes, after the trouble-clearing-up judging unit judges that the trouble is cleared up, the image-bearing-body-rotational speed into a changed speed value that is smaller than the normal speed value, thereby allowing the image bearing body to rotate at the image-bearing-body-rotational speed of the changed speed value.

9. An image forming apparatus, comprising:

a conveying unit conveying a recording medium;

a trouble-detecting unit detecting whether some trouble occurs against conveyance of the recording medium;

a trouble-clearing-up judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body; and a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges cleaning-up of the trouble, wherein the control unit rotates the image bearing body at a normal image-bearing-body-rotational speed when the trouble-detecting unit detects no trouble, the control unit rotating the image bearing body at a changed image-bearing-body-rotational speed that is lower than the normal image-bearing-body-rotational speed after the trouble-clearing-up judging unit judges the clearing-up of the trouble.

10. An image forming apparatus, comprising:

a conveying unit conveying a recording medium;

a trouble-detecting unit detecting whether some trouble occurs against conveyance of the recording medium;

a trouble-cleaning-up, judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body; and a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-up of the trouble, wherein the control unit rotates the cleaning roller at a normal cleaning-roller-rotational speed when the trouble-detecting unit detects no trouble, the control unit rotating the cleaning roller at a changed cleaning-roller-rotational speed that is higher than the normal cleaning-roller-rotational speed after the trouble-clearing-up judging unit judges the clearing-up of the trouble.

11. An image forming apparatus, comprising:

a conveying unit conveying a recording medium;

a trouble-detecting unit detecting whether some trouble occurs against conveyance of the recording medium;

a trouble-clearing-up judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body; and a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-up of the trouble, wherein the control unit applies the cleaning roller with a normal cleaning-bias voltage when the trouble-detecting unit detects no trouble, the normal cleaning-bias voltage causing a potential difference between the cleaning roller and the image bearing body to become a normal potential value, and the control unit applies the cleaning roller with a changed cleaning-bias voltage after the trouble-clearing-up judging unit judges the clearing-up of the trouble, the changed cleaning-bias voltage causing the potential difference to become greater than the normal potential value.

12. An image forming apparatus, comprising:

a conveying unit conveying a recording medium;

a trouble-detecting unit detecting whether some trouble occurs against conveyance of the recording medium;

a trouble-cleaning-up, judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body; and a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-up of the trouble, wherein when the trouble-detecting unit detects no trouble, the control unit rotates the cleaning roller at a normal cleaning-roller-rotational speed and applies the cleaning roller with a normal cleaning-bias voltage, the normal cleaning-bias voltage causing a potential difference between the cleaning roller and the image bearing body to become a normal potential value, and after the trouble-clearing-up judging unit judges the clearing-up of the trouble, the control unit rotates the cleaning roller at a changed cleaning-roller-rotational speed that is higher than the normal cleaning-roller-rotational speed, and applies the cleaning roller with a changed cleaning-bias voltage, the changed cleaning-bias voltage causing the potential difference to become greater than the normal potential value.

13. An image forming apparatus, comprising:

a conveying unit conveying a recording medium;

a trouble-detecting unit detecting whether some trouble occurs against conveyance of the recording medium;

a trouble-cleaning-up, judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body; and a control unit applying the transfer unit with a bias voltage of a polarity opposite to that of the developing agent when the trouble-detecting unit detects no trouble, the control unit applying, when the trouble-judging unit detects some trouble, the transfer unit with a bias voltage of a polarity the same as that of the developing agent after the trouble-clearing-up judging unit judges clearing-up of the trouble, wherein when the trouble-detecting unit detects no trouble, the control unit rotates the image bearing body at a normal image-bearing-body-rotational speed, rotates the cleaning roller at a normal cleaning-roller-rotational speed, and applies the cleaning roller with a normal cleaning-bias voltage, the normal cleaning-bias voltage causing a potential difference between the cleaning roller and the image bearing body to become a normal potential value, and after the trouble-clearing-up judging unit judges the clearing-up of the trouble, the control unit rotates the image bearing body at a changed image-bearing-body-rotational speed that is lower than the normal image-bearing-body-rotational speed, rotates the cleaning roller at a changed cleaning-roller-rotational speed that is higher than the normal cleaning-roller-rotational speed, and applies the cleaning roller with a changed cleaning-bias voltage, the changed cleaning-bias voltage causing the potential difference to become greater than the normal potential value.

14. An image forming apparatus, comprising:

a conveying unit conveying a recording medium;

a trouble-detecting unit detecting whether some trouble occurs against conveyance of the recording medium;

a trouble-clearing-up judging unit judging whether the trouble detected by the trouble-detecting unit has been cleared up;

an image bearing body bearing thereon a visible image, which is made from a developing agent electrically charged in a predetermined polarity;

a transfer unit located opposing the image bearing body and transferring the visible image onto the recording medium;

a cleaning roller located opposing and contacting the image bearing body and collecting the developing agent from the image bearing body;

a control unit controlling at least one of the cleaning roller and the image bearing body in a first condition when the trouble-detecting unit detects no trouble, the control unit controlling, when the trouble-judging unit detects some trouble, the at least one of the cleaning roller and the image bearing body in a second condition that is different from the first condition after the trouble-clearing-up judging unit judges clearing-up of the trouble;

a voltage applying unit applying a cleaning-bias voltage to the cleaning roller with respect to the image bearing body; and a driving unit rotating the cleaning roller at a cleaning-roller-rotational speed, wherein the control unit includes:

a setting unit that sets at least one of the cleaning-bias voltage and the cleaning-roller-rotational speed to a predetermined normal value while the trouble-detecting unit detects no trouble; and a changing unit that changes, after the trouble-clearing-up judging unit judges that the trouble is cleared up, at least one of the cleaning-bias voltage and the cleaning-roller-rotational speed into a changed value that is different from the predetermined normal value, wherein the setting unit sets at least one of an absolute value of the cleaning-bias voltage and the cleaning-roller-rotational speed to the predetermined normal value, the changing unit changing a the at least one of the absolute value of the cleaning-bias voltage and the cleaning-roller-rotational speed into the changed value that is greater than the predetermined normal value.

* * * * *